US008026860B2

(12) United States Patent
Mayes et al.

(10) Patent No.: US 8,026,860 B2
(45) Date of Patent: Sep. 27, 2011

(54) ELECTRICALLY SMALL ANTENNA DEVICES, SYSTEMS, APPARATUS, AND METHODS

(75) Inventors: Paul E. Mayes, Champaign, IL (US); Paul W. Klock, Urbana, IL (US); Suhail Barot, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 475 days.

(21) Appl. No.: 12/284,161

(22) Filed: Sep. 18, 2008

(65) Prior Publication Data

US 2009/0146893 A1 Jun. 11, 2009

Related U.S. Application Data

(60) Provisional application No. 60/994,171, filed on Sep. 18, 2007, provisional application No. 61/192,277, filed on Sep. 17, 2008.

(51) Int. Cl.
*H01Q 21/00* (2006.01)

(52) U.S. Cl. ..... 343/810; 343/797; 343/798; 343/799; 343/800; 343/815; 343/816; 343/812; 343/813; 343/814

(58) Field of Classification Search ..... None
See application file for complete search history.

(56) References Cited

U.S. PATENT DOCUMENTS

| | | | | |
|---|---|---|---|---|
| 3,454,950 | A | 7/1969 | Grant et al. | |
| 3,604,007 | A * | 9/1971 | Solby | 343/720 |
| 3,710,340 | A | 1/1973 | Mayes | |
| 3,716,867 | A | 2/1973 | Mayes et al. | |
| 5,519,407 | A * | 5/1996 | Mileski | 343/722 |
| 6,337,664 | B1 | 1/2002 | Mayes et al. | |
| 6,456,249 | B1 | 9/2002 | Johnson et al. | |
| 6,608,598 | B2 | 8/2003 | Gee et al. | |
| 7,084,824 | B2 | 8/2006 | Mendenhall et al. | |
| 7,330,152 | B2 | 2/2008 | Zhang et al. | |
| 2003/0020656 | A1 * | 1/2003 | Shor | 343/7 MS |
| 2003/0169204 | A1 | 9/2003 | Saito | |
| 2005/0017906 | A1 | 1/2005 | Man et al. | |

FOREIGN PATENT DOCUMENTS

WO WO 2007/118824 A2 10/2007

* cited by examiner

*Primary Examiner* — Trinh Dinh
(74) *Attorney, Agent, or Firm* — Krieg DeVault LLP; L. Scott Paynter

(57) ABSTRACT

The utilization of small antennas for mobile devices and for low frequency (long wavelength) applications is desired. Further, efficient use of transmission power is desirable, especially in mobile applications. For this purpose, a system is provided that includes one or more of: a multiple-resonator transmitter/receiver, a high bandwidth electrically small antenna, a resonator with a variable feed location, a resonator with a variable reactive component load, and a method for estimating a resonator system response to a component configuration and selected excitation.

27 Claims, 18 Drawing Sheets

| Freq. (MHz) | Dpl 1 Lng(cm) | Spac(cm) | Ind1(nH) | at*(cm) | Ind2(nH) | at**(cm) |
|---|---|---|---|---|---|---|
| 500(5)1000 | 9.28 | 1.40 | 125.15 | 3.93 | 136.5 | 6.79 |

ELECTRICALLY SMALL ANTENNA DEVICES, SYSTEMS, APPARATUS, AND METHODS

CROSS-REFERENCE TO RELATED APPLICATIONS

The present application claims the benefit of U.S. Provisional Patent Application No. 60/994,171 filed Sep. 18, 2007, and U.S. Provisional Patent Application No. 61/192,277 filed Sep. 17, 2008, each of which are hereby incorporated by reference in its entirety.

BACKGROUND

The present application relates to antennas, and more particularly, but not exclusively, relates to the increasing the bandwidth of an electrically small antenna. In one nonexclusive application, this antenna technology finds application in wireless communications. As used herein, the term "electrically small" when used to describe an antenna refers to an antenna with a maximum dimension less than one-half the wavelength of its operating frequency.

Electrically small antennas present operating challenges in the current art and commonly are considered to perform poorly. An antenna performs most efficiently when the maximum power is transferred to the antenna (for a transmitter) or from the antenna (for a receiver) for a given power input. To maximize power transfer, it is often desirable to closely match input impedance of the antenna to the characteristic impedance of the power line operatively coupled thereto. Maximum power transfer can occur when the real part of the matched impedances have the same magnitude (the resistances), and when the imaginary parts (the reactances) have the same magnitude and are of opposite signs, such that they are 180 degrees out of phase with one another. Because the impedances of low-loss transmission lines are nearly real, it is often the case that an antenna is most effective when near self-resonance, where the antenna input reactance is nearly zero. The input impedance of an electrically small antenna can be difficult to match because the radiation from a small transmitting antenna is inversely related to the antenna size in wavelengths, whence the antenna reactance is small as also is the antenna resistance.

Antennas that are physically small compared to wavelength have input impedances with relatively large reactance values except near the resonance frequency. At resonance, the input reactance tends to diminish and the input resistance is usually small. Therefore, electrically small antennas typically demonstrate relatively small match bandwidth.

Consumers are typically interested in electronic devices that are smaller and more efficient in power usage, allowing longer use and battery life. Additionally or alternatively, it is often desirable to increase the bandwidth of communication devices such as mobile phones, GPS devices, radios, and the like. The space occupied by an antenna relative to its effectiveness is often of interest in relation to such equipment. Thus, there is a need for further contributions in this area of technology.

SUMMARY

One embodiment of the present application includes a unique antenna and/or unique wireless communication technique. Other embodiments include unique antenna methods, systems, devices, and apparatus. Further embodiments, forms, features, aspects, benefits, and advantages of the present application shall become apparent from the description and figures provided herewith.

DETAILED DESCRIPTION OF REPRESENTATIVE EMBODIMENTS

Figure 1:
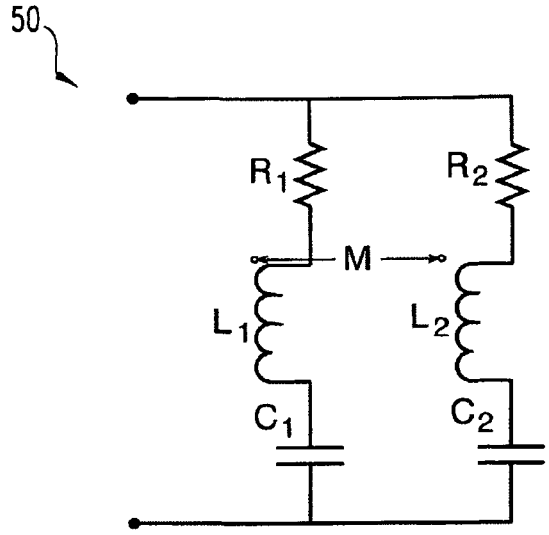
FIG. 1 is a schematic diagram of a circuit illustrating a one-port network having two parallel, lossy series resonators including magnetic coupling.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Electrically small antennas are usually characterized as having small radiation resistance and small operating bandwidth. These characteristics can be ameliorated by (a) using an offset feed and/or (b) introducing multiple radiating resonators having different resonant frequencies. For the radiating resonator approach, the input impedance goes from inductive to capacitive in the vicinity of one resonant frequency. Similar behavior is obtained from a parallel combination of an inductor and a capacitor. Losses in such a circuit can be represented by a resistor in parallel with the inductor and capacitor. At zero frequency, the losses of radiation are zero and the input impedance is likewise zero. The locus of the input impedance versus frequency produces a trace on the Smith Chart that starts at zero for zero frequency, goes through increasingly larger values of inductive reactance until reaching the resistive value, R, at the frequency of resonance (often called anti-resonance for a parallel circuit), and continues on the capacitive side of the chart for higher frequencies. Thus, an opportunity to approximately match the real value of impedance is near the resonant frequency, and the bandwidth of approximate match can be determined by the value of R. The value of R may be determined by the radiation, but is also dependent upon the location of the feed point.

Figure 15:
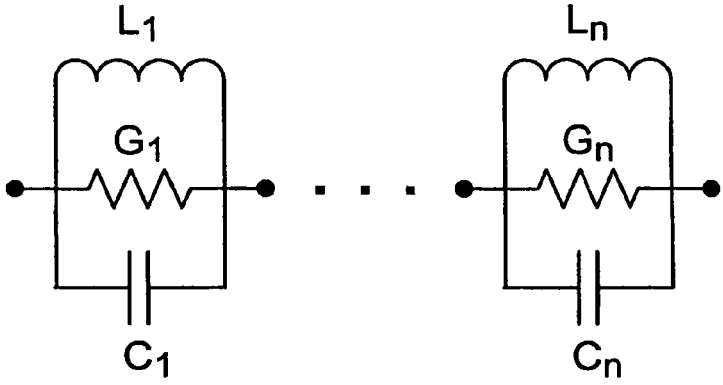
FIG. 15 is a schematic diagram of a circuit with parallel (tank) circuit resonators in series.

It has been discovered that the match bandwidth can be desirably expanded with the proper spacing and arrangement of multiple resonances. By way of introduction, consider the ideal, lumped element model of several tank circuits connected in series, such as depicted in FIG. 15. At zero frequency, in the system of FIG. 15, all of the capacitors C ($C_1 \ldots C_n$) are open and all of the inductors L ($L_1 \ldots L_n$) are shorts so that the input impedance is zero. The losses caused by any radiation that may occur from the circuit is represented by conductance G (($G_1 \ldots G_n$) in parallel. As frequency increases, the net input impedance is inductive reactance until the lowest frequency at which resonance occurs. Suppose the resonators are arranged in order of increasing resonant frequency, ($\omega_1<\omega_2< \ldots \omega_n \ldots <\omega_N$). When the operating frequency, $\omega$, is equal to $\omega_n$, then all of the tanks with resonant frequency $\omega_0$ such that $\omega_0<\omega_n$ will have impedance which is inductive and the others will have impedance which is capacitive. As a result, there will be a series resonance between two adjacent parallel resonances. When taken together, all resonances form an alternating set of parallel and series resonances. For a theoretical lossless system, the resulting input impedance will trace the rim of the Smith Chart. When losses are present, the impedance locus will fall in an area that is inside the chart. A similar argument can be applied to the circuit of FIG. 1, a system comprising series-type resonators connected in parallel. According, it has been demonstrated that series (RLC) circuit resonators and parallel (tank) circuit resonators are duals of each other such that the evaluation of one applies to the other as applied to antenna systems as well as lumped element circuitry.

Nonetheless, it should be appreciated that while the impedance of dipoles has a behavior that is similar to that of an idealized, series RLC, lumped element circuit; a dipole antenna implementation would be expected to include significant differences that complicate the comparison. For instance, the effective resistance of a combination of dipole antennas may not be independent of frequency. While it may be possible to devise a frequency-dependent resistance for a system of series RLC circuits, it is not apparent how this should be done for a dipole antenna. For electrically small antennas, the variation in resistance over the pertinent frequency band is apt to be negligibly small so that a constant resistance is a reasonable approximation. In addition, the input impedance of a combination of dipole antennas may be dependent upon the field coupling between the various dipoles in the combination. Accordingly, several experiments have been performed to evaluate the concept of using approximate equivalent circuits to represent the behavior of a radiating system as further described hereinafter.

A combination of series RLC circuits in parallel can be made to produce nearly coincident loops on the Smith Chart. In order to make such a combination of dipoles have practical importance, certain special requirements need to be considered. If the locus of input impedance can be made to have the form of coincident loops on the Smith Chart, and if these loops can be placed near the center of the chart, then the reflection coefficient magnitude will remain nearly constant over the bandwidth encompassed by the loops. If, furthermore, this can be accomplished by using radiating resonators that are small compared to the wavelength for all frequencies in this band, then the realization of an electrically small antenna with wideband match is possible.

FIG. 1 is a schematic diagram of a circuit illustrating a one-port network having two parallel, lossy series resonators including magnetic coupling (M). The analysis of these circuits provides guidelines that are useful in the design of small antennas. While one advantage of circuit models is that consideration of coupling is optional, it may not be the case for radiating devices because coupling between radiating resonators may be difficult to eliminate in practice. The voltage equations of the circuit shown in FIG. 1 are:

$$V_1=(R_1+j\omega L_1+1/j\omega C_1)I_1+j\omega MI_2$$

$$V_2=j\omega MI_1+(R_2+j\omega L_2+1/j\omega C_2)I_2 \qquad \text{Equation (1)}$$

Equation (1) illustrates a special case of the general equations for a two-port network that are usually written in matrix form as:

$$\begin{bmatrix} V_1 \\ V_2 \end{bmatrix} = \begin{bmatrix} Z_{11} & Z_{12} \\ Z_{21} & Z_{22} \end{bmatrix} \begin{bmatrix} I_1 \\ I_2 \end{bmatrix}; \quad \text{Equation (2)}$$

where:

$$Z_{nn} = R_n + j(\omega L_n - 1/\omega C_n) \quad \text{Equation (3)}$$
$$Z_{mn} = j\omega M.$$

The electrical currents can be expressed in terms of the voltages by inverting the square matrix of Equation (2):

$$\begin{bmatrix} I_1 \\ I_2 \end{bmatrix} = \left(\frac{1}{\Delta}\right) \begin{bmatrix} Z_{22} & -Z_{12} \\ -Z_{21} & Z_{11} \end{bmatrix} \begin{bmatrix} V_1 \\ V_2 \end{bmatrix}. \quad \text{Equation (4)}$$

When the series resonators are in parallel and a unit voltage generator is applied, the following relationships result:

$V_1=V_2=1.0I_1+I_2=I$ where, $I_1=(1/\Delta)(Z_{22}-Z_{12})$ $I_2=(1/\Delta)(Z_{11}-Z_{12})$ $\Delta=Z_{11}Z_{22}-Z_{12}^2$ assuming that $Z_{12}=Z_{21}$ (i.e., assumption of reciprocity).

These results describe the input current of a one-port network, as:

$$I = (1/\Delta)(Z_{11} + Z_{22} - 2Z_{12}) = \frac{Z_{11} + Z_{22} - 2Z_{12}}{Z_{11}Z_{22} - Z_{12}^2}. \quad \text{Equation (5)}$$

In the absence of coupling, $Z_{12}=0$, the input current response to a one-volt source is given by:

$$I = \frac{1}{Z_{11}} + \frac{1}{Z_{22}} = \frac{1}{R_1 + j\left(\omega L_1 - \frac{1}{\omega C_1}\right)} + \frac{1}{R_2 + j\left(\omega L_2 - \frac{1}{\omega C_2}\right)}. \quad \text{Equation (6)}$$

Secondary parameters can be introduced as follows:

$$\omega_{0n} = \frac{1}{\sqrt{L_n C_n}} \quad \text{Equation (7)}$$

$$R_{0n} = \sqrt{\frac{L_n}{C_n}}$$

so that $$L_n = \frac{R_{0n}}{\omega_{0n}}$$

$$C_n = \frac{1}{\omega_{0n} R_{0n}}$$

$$I = \sum_{n=1}^{n=2} \left(\frac{1}{R_{0n}}\right)\left[\frac{R_n}{R_{0n}} + j\left[\frac{\omega}{\omega_{0n}} - \frac{\omega_{0n}}{\omega}\right]\right]^{-1}.$$

Equation (7) is in a form that can be extended so that an arbitrary number of series resonators can be added in parallel. When the resonances of the system are related in a log-periodic manner, $\omega_{0n}=\omega_{01}\tau^{(1-n)}$, the log-periodic connection among the resonances can be achieved by scaling the physical dimensions of each resonator; where $\tau$(tau) is a constant ratio that is less than one in this context. One result of such scaling would be to achieve the same value of $R_0$ for all resonators. Furthermore, if the input impedance is normalized to this value, a general expression for the normalized impedance ("nor") is:

$$Z_{nor} = \frac{1}{\sum_{n=1}^{N} \frac{1}{R_{nnor} + j\left(\frac{\omega\tau^{(1-n)}\omega_{01}}{\omega_{01}} - \frac{\omega_{01}}{\omega\tau^{(1-n)}\omega_{01}}\right)}}. \quad \text{Equation (8)}$$

Several observations about the behavior of the parallel connection of series resonators can be made by inspection of Equation (8). When $R_n$ is not zero, the impedance versus frequency locus will lie inside the unit circle on the reflection coefficient plane (e.g. on a Smith Chart) and variation of $R_{0n}$ will be effective in the placement of the locus. Given that radiation loss will generally be present in an antenna, the above result can be used advantageously to affect the degree of match to a feeder.

Figure 2:
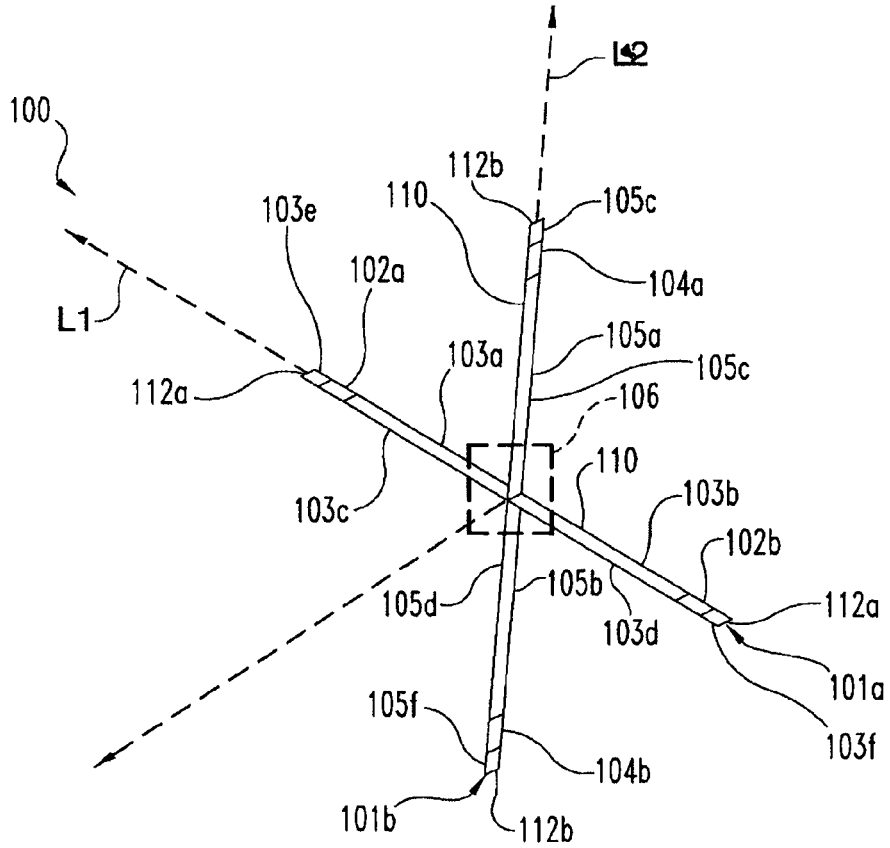
FIG. 2 is a partially schematic, perspective view of multiple resonators for increasing the bandwidth of an electrically small antenna.

FIG. 2 is a schematic diagram of system 100 including antenna device 101 in the form of two blade dipole antenna configurations 101*a* and 101*b*. Each configuration 101*a* and 101*b* is also alternatively depicted as one of dipole antennas 110. Devices 110 include reactances that, together with the length, determine the resonant frequency of the respective dipole. The dipole configuration 101*a* includes two legs' 103*a* and 103*b* each incorporating a respective resonator reactance element 102*a* and 102*b*. Elements 102*a* and 102*b* may be each in the form of a pair of lumped inductors electrically connected with electrically conductive elements of configuration 101A on opposite sides. These elements are depicted as electrically conductive members 103*c*-103*f*. Members 103*e* and 103*f* each define a respective outer end 112*a*.

The dipole configuration 101*b* includes two antenna legs 105*a* and 105*b* each incorporating a respective resonator reactance element 104*a* and 104*b*. Elements 104*a* and 104*b* may be each in the form of a pair of lumped inductors electrically connected to electrically conductive elements of configuration 101*b* on opposite sides. These elements are depicted as electrically conductive members 105*c*-105*f*. Members 105*e* and 105*f* each define a respective outer end 112*b*. In one arrangement, the electrical conductive elements (members 103*c*-103*f* and 105*c*-105*f*) are provided in the form of solid metallic strips. The system 100 further includes circuitry 106 (refer to the sections discussing FIGS. 3 and 6 for example embodiments of circuitry 106) configured to connect the antenna device 101 to a voltage source in an approximately central location in a generally symmetric manner relative to each configuration 101*a* and 101*b*.

Dipole antennas 110 of configurations 101*a* and 101*b* each extend along a longitudinal axis L1 and L2, respectively. As depicted, axes L1 and L2 are generally perpendicular to one another; however, in other embodiments, the geometry may vary. For instance, in one preferred embodiment, dipole antennas 110 are oriented such that the legs 103*a* and 103*b* are not coaxial, but instead oriented at an angle to one another. Additionally or alternatively, legs 105*a* and 105*b* are not coaxial and oriented at an angle to one another. This angular, non-coaxial arrangement of legs of the same dipole antenna has been surprisingly discovered in at least some cases to reduce undesired coupling between different dipole antennas. In a more preferred embodiment, the legs of each the dipole antenna are oriented to be approximately perpendicular to the other. In one such perpendicular orientation, the first leg of one dipole antenna is approximately coaxial with the first leg of another dipole antenna such that they are positioned opposite each other along a first longitudinal axis; and the second leg of the one dipole is approximately coaxial with the second leg of the other dipole antenna such that they are positioned opposite each other along a second longitudinal axis. This second longitudinal axis intersects the first longitudinal axis perpendicularly.

Figure 3:
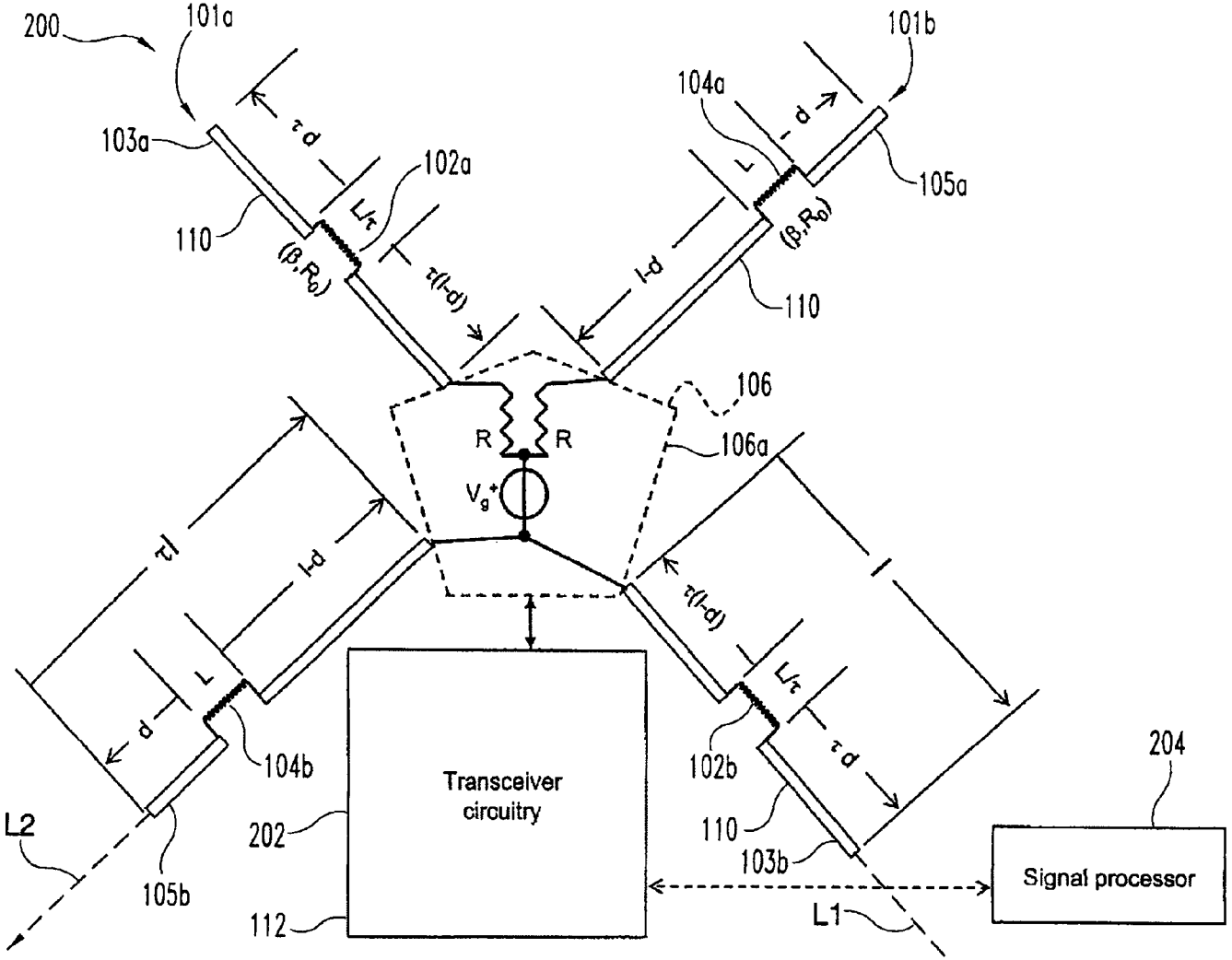
FIG. 3 is a schematic diagram illustrating a system for increasing the bandwidth of an electrically small antenna.

FIG. 3 is a schematic diagram illustrating system 200 that includes many of the electrically small antenna features of system 100; where like reference numerals refer to like features previously described. Antennas 110 of system 200 may be oriented with any of the geometries described previously in connection with system 100. In FIG. 3, circuitry 106 is shown schematically to illustrate operative connections and circuits. Circuitry 106 includes feed line connection circuitry 106*a* to couple antennas 110 together in parallel, and communication circuitry 112 coupled to feed Line 106*a*. Circuitry 112 includes transceiver circuitry 202 and signal processor 204. The resistances (R) represent intrinsic resistance and/or radiation loss expected for the device. The inductor devices L and L/τ may be partially or entirely lumped inductors. The resonator elements 102*a* and 102*b* of configuration 101*a* and the resonator elements 104*a*, 104*b* of configuration 101*b* are arranged to provide resonance properties to increase the frequencies over which system 200 effectively operates. Circuitry 106 further includes an approximately centrally-located feeder ($V_g^+$) in the form of a voltage source. However, in other embodiments, position of the feed line (and correspondingly the feed point) may vary, such that it is not central, but rather is offset. In an alternative embodiment dedicated to reception of signals from an antenna, a signal source or feeder of the type indicated may not be included.

Transceiver circuitry 202 includes an integrated transmitter and receiver, although in other applications, the transmitter and receiver are separate, and in one-way applications only one or the other may be present. Transceiver circuitry 202 sends and receives signals to antennas 110, and communicates with signal processor 204 to provide desired encoding of information/data in the signals, as might be desired for a wireless communication application of system 200. In alternate embodiments, circuitry 202 and/or signal processor 204 may be absent.

Circuitry 112 includes appropriate signal conditioners to transmit and receive desired information (data), and correspondingly may include filters, amplifiers, limiters, modulators, demodulators, CODECs, signal format converters (such as analog-to-digital and digital-to-analog converters), clamps, power supplies, power converters, and the like as needed to perform various control, communication, and regulation operations described herein. Processor 204 can be comprised of one or more components of any type suitable to process the signals received from transceiver circuitry 202 or elsewhere, and provide desired output signals. Such components may include digital circuitry, analog circuitry, or a combination of both. Processor 204 can be of a programmable type; a dedicated, hardwired state machine; or a combination of these; and can further include multiple processors, Arithmetic-Logic Units (ALUs), Central Processing Units (CPUs), or the like. For forms of processor 204 with multiple processing units, distributed, pipelined, and/or parallel processing can be utilized as appropriate.

Processor 204 may be dedicated to performance of just the operations described herein or may be utilized in one or more additional applications. In one form, processor 204 is of the programmable variety that executes algorithms and processes data in accordance with operating logic that is defined by programming instructions (such as software or firmware). One or more types of memory may be included, too. When present, such memory can be of a solid-state variety, electromagnetic variety, optical variety, or a combination of these forms. Furthermore, memory can be volatile, nonvolatile, or a mixture of these types, and some or all of such memory can be of a portable type, such as a disk, tape, memory stick, cartridge, or the like. Any memory present can be at least partially integrated with processor 204. In one form, a memory stores programming instructions executed by processor 204 to embody at least a portion of this operating logic. Alternatively or additionally, memory can store data that is manipulated by the operating logic of processor 204, such as data representative of signals received from and/or sent to transceiver circuitry 202, just to name one example. Alternatively or additionally, operating logic for processor 204 is at least partially defined by hardwired logic or other hardware.

Figure 4:
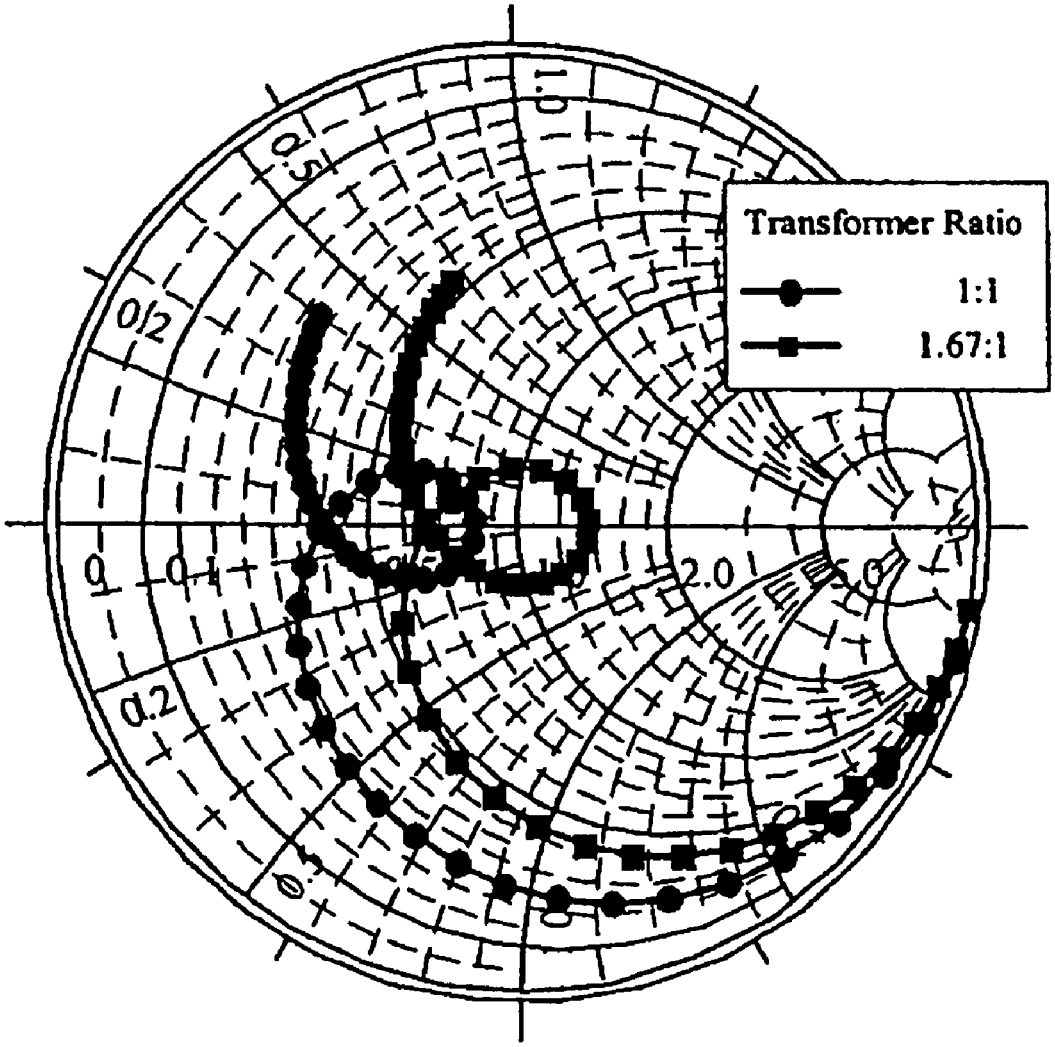
FIG. 4 is an example Smith Chart illustrating a computed input impedance for one arrangement of a two series resonators showing how the antenna input impedance is affected by transformers of differing transformation ratio.

FIG. 4 is an example Smith Chart illustrating a computed input impedance for a pair of series resonators connected in parallel. When the two series resonators are connected in parallel, the impedance locus can be made to form a loop. The loop on the left in FIG. 4, illustrated with circular data points, is an example of an impedance locus that can be achieved with two series resonators in parallel. In this example, the loop is not centered on the chart and so provides a match that varies with frequency.

In one embodiment, an external transformer may be included with the multiple resonators to center the chart. In the example of FIG. 4, a transformer with a ratio of 1.67 moves the loop to approximately the center of the chart. The second loop in FIG. 4, illustrated with square data points, is the result of attaching a transformer of appropriate transformation ratio to move the center of the loop closer to the center of the chart, improving the impedance match. For FIG. 4, the computation values were R1=R2=10 ohms, R01=R02=25 ohms, tau (τ)=0.5, with frequency relative to first resonance of 0.1(0.5)2.5.

Figure 5:
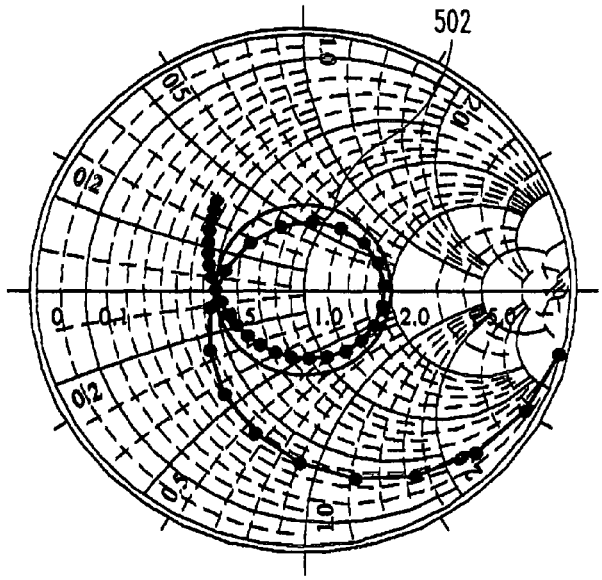
FIG. 5 is an example Smith Chart illustrating a computed input impedance for another arrangement of two series resonators wherein near optimum match is obtained by adjusting the antenna parameters (no transformer is needed)

FIG. 5 is an example Smith Chart illustrating a computed input impedance for two lumped-element resonators; where R1=R2=12.5 ohms, R01=R02=25 ohms, tau (τ)=0.3, with frequency relative to first resonance of 0.1(0.1)4.0. The example shown in FIG. 5 is based on estimates assuming a lumped-element network. In many cases the improved match can be obtained by changing the parameters of the antenna itself and no external transformer is necessary. FIG. 5 shows a case where the impedance loop circles the center of the chart in such a manner that any operating frequency provides approximately the same degree of mismatch. In those cases where the operating specification for the antenna defines a maximum allowable Standing Wave Ratio (SWR), often placing the loop so that it passes through the maximum SWR value will produce a degree of mismatch that will be about the same for all other frequencies in the operating band. A single value of τ, the ratio of the resonant frequencies of each of the two resonators, yields the value of input resistance at the parallel resonance that occurs between the two series resonances, which largely determines the size of the loop. Notice that the part of the impedance locus for τ=0.5, that is contained within the SWR=2 circle encompasses a bandwidth of around 2:1. To achieve this result, there is: (a) a normalized resistance of approximately 0.5 of each resonator at series resonance, and (b) a normalized resistance of approximately 2.0 for the total network at the parallel resonance that falls between the two series resonances. The former value is determined from the radiation resistance of the antenna at resonance and the characteristic impedance.

The form of Equation (8) suggests that this pattern of behavior will repeat for higher frequencies. Based on these principles, a network may thus have a given degree of impedance match over an arbitrarily wide frequency band. However, other factors may limit the construction of a multiple resonator network, for example, the number of resonators that can be connected within an available space may be limited.

In the example shown in FIG. 5, the value of $R_n/R_{0n}$ was selected to place the point of intersection of the impedance loop on the SWR=2 locus. The value of $\tau$ was selected to place the point on the opposite side of the loop also on the SWR=2 curve 502. Thus, FIG. 5 illustrates all impedance points in the operating band having an SWR less than 2. The SWR is decreased by placing the series resonances closer together. The center of the impedance loop can be located at various points on the real axis by choosing the characteristic impedances of the resonators.

Figure 6:
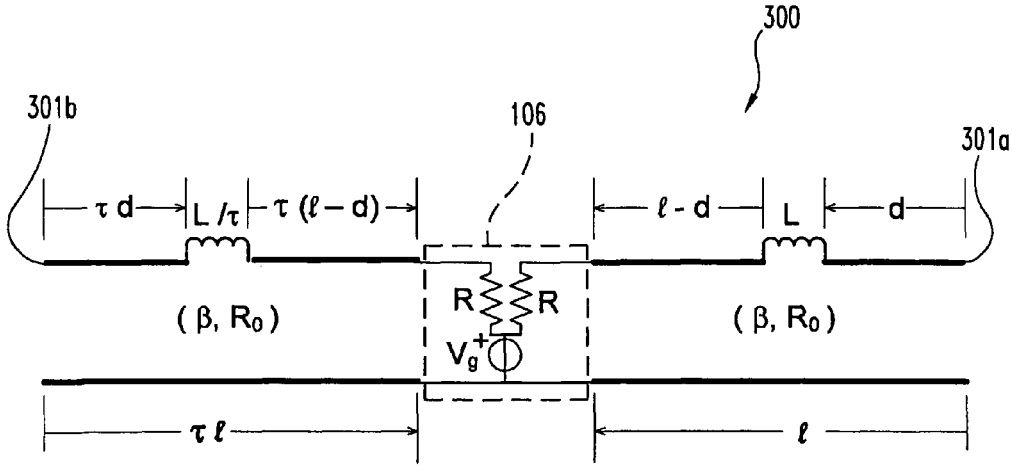
FIG. 6 is a schematic circuit diagram of two transmission-line resonators that can be designed to have impedance very similar to that of the lumped circuits shown in previous figures.

FIG. 6 is a schematic circuit diagram of antenna system 300 including one embodiment of two transmission-line antennas 301*a* and 301*b* in accordance with the present application; where like reference numerals refer to like features. Antennas 301*a* and 301*b* of system 300 may be oriented perpendicular to one another or with another geometry selected to provide desired decoupling, as otherwise described previously in connection with system 100. Generally, a transmission-line resonator can be constructed from a section of uniform transmission line that is terminated at a first end with an open circuit and terminated at a second end with a short circuit. A transmission-line terminated in open-short will be resonant at many values of its length, with the smallest being one-quarter wavelength. Alternatively, the transmission-line can be terminated with a capacitive reactance instead of the open, and with an inductive reactance instead of the short. The use of reactive termination rather than open-short termination allows relatively shorter lengths for the resonance.

Termination with reactive elements may occur at other locations in the transmission-line rather than the ends. The realization of various values of normalizing impedance can be achieved in distributed resonators by simply choosing the location of the feedpoint, or the power source to the transmission line. The input resistance of a radiating resonator can be varied by changing the location of the feed point. Consider, for example, a section of transmission line that is terminated on one end in an open circuit and on the other in a short circuit. The resistance seen at the input of such a line at resonance can be varied from zero to infinity by moving the feed point along the line from one terminated end to the other.

By connecting in parallel two resonators with resonant frequencies that have the proper ratio, a loop can be produced in the impedance locus. Specifically, FIG. 6 illustrates the schematic diagram for antenna system 300 with transmission-line antennas 301*a* and 301*b* that are loaded in the interior to reduce their lengths at resonance. In the embodiment of FIG. 6, the ratio $\tau$ between the resonators results in a first resonator half-length of l and a second resonator half-length of $\tau$ times l. A lumped inductor (L, L/$\tau$) is included within each resonator. The embodiment of FIG. 6 is asymmetrical, i.e. only one leg of each of the l-length antennas 301*a* and the $\tau$l-length antenna 301*b* have a reactive component, L and L/$\tau$, respectively. In an alternate embodiment, a reactive component may be included on each leg of each resonator, for example as shown in FIG. 3.

Figure 7:
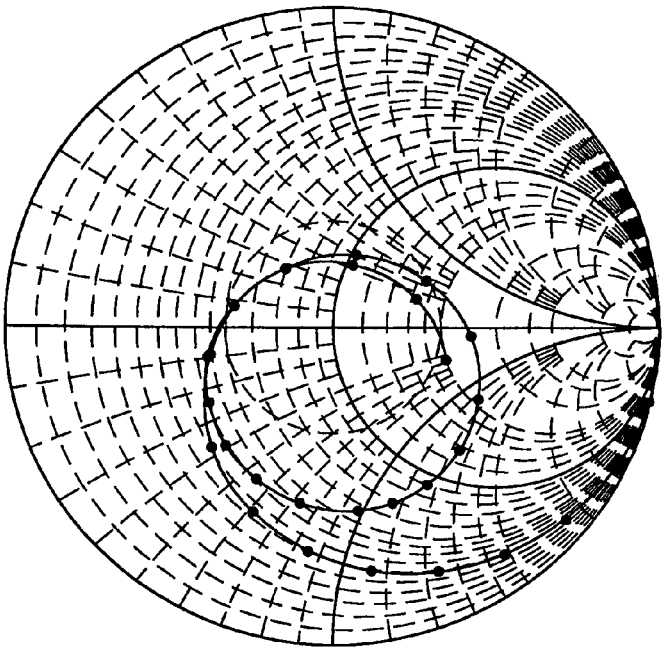
FIG. 7 is an example Smith Chart illustrating computed input impedance for two transmission-line resonators of FIG. 6.

FIG. 7 is an example Smith Chart illustrating a computed input impedance for one embodiment of two transmission-line resonators in accordance with the present application. Specifically, the resonators are in parallel with $l_1$=3.75 cm, $d_1$=2, $\tau$=0.5, $f_{01}$=1 GHz, and r=0.5. For the example of FIG. 7, resistive loads provide the loss and the normalized impedance is the ratio of this resistance to the input resistance (at resonance) at the feed point. Hence, the normalization can be adjusted by choosing the point of attachment to the resonator. As shown in the FIG. 7, the input impedance computed for frequencies between 1 and 2 GHz has a loop that includes the center of the Smith Chart. FIG. 7 illustrates a capacitive shift such that the center of the loop and the center of the chart do not coincide. In one embodiment, the capacitive shift is compensated (not shown) by a series inductor at the input of the network. The first resonance occurs at 1 GHz such that l/$\lambda$=0.125. Hence, the embodiment of FIG. 7 is considered "electrically small" as previously defined herein. At the second series resonance, l/=0.25 and the embodiment in FIG. 7 remains electrically small. The fourth crossing of the real axis demonstrates the effect of a higher resonance of one of the lines and could be a point within or outside of the operating band.

Figure 8:
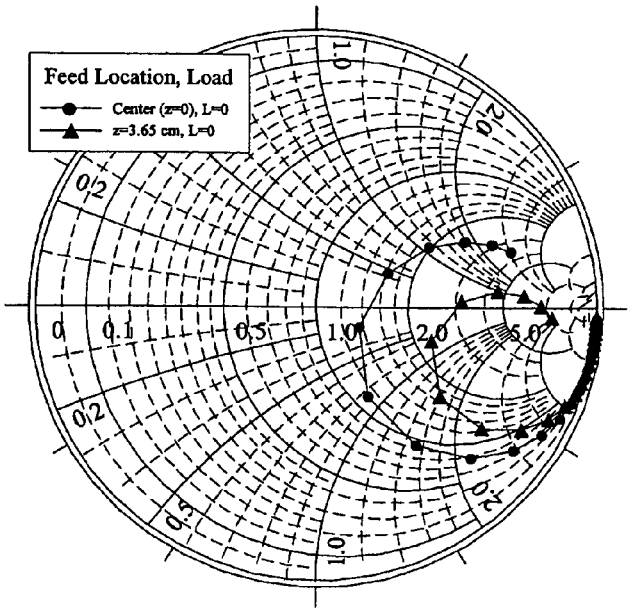
FIG. 8 is an example Smith Chart illustrating computed input impedances for blade dipoles with feed points located at different places.

FIG. 8 is an example Smith Chart illustrating computed input impedances for two different blade dipole configurations with different feed points in accordance with the present application. FIG. 8 illustrates the computed input impedance for planar blade dipoles of length 14.6 cm (half length of 7.3 cm) and width 0.5 cm that are fed (i.e. —power input location) off-center. The feed location relative to the center of the dipole is given in the first column of the legend—i.e. one curve shows center feed (z=0) and the second curve shows offset feed (z=6.5 cm).

Figure 9:
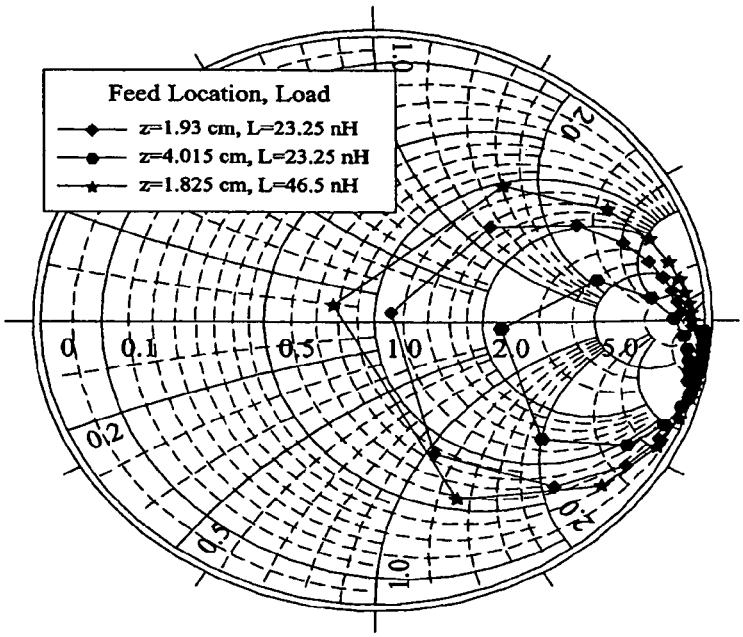
FIG. 9 is an example Smith Chart illustrating computed input impedance for blade dipoles with feed points and load inductances located as indicated.

Referring to FIG. 9, the computed input impedance is shown for three planar blade dipole configurations each of length 14.6 cm and width 0.5 cm. The resulting plots show the effect of various locations for the source and various values of loading with inductive reactance. The plots are shown for two input loads (23.25 nH on two curves, and 46.5 nH on one curve), and three feed locations (1.93 cm, 4.015 cm, and 1.825 cm). All loads are illustrated at a lowest available point on the upper half of each dipole (i.e. approximately base loading). As the load inductance increases from 0 to 46.5 nH, the resonant frequency and bandwidth decreases.

FIG. 9 illustrates the principle that as the feed is moved toward the tip of the blade dipole, the resistance at resonance increases. The locations of each feed, and the presence and location of each load, are illustrated for example purposes only, and any feed placement, loading value and loading placement physically available on a particular embodiment are contemplated within the scope of the present application.

Figure 10:
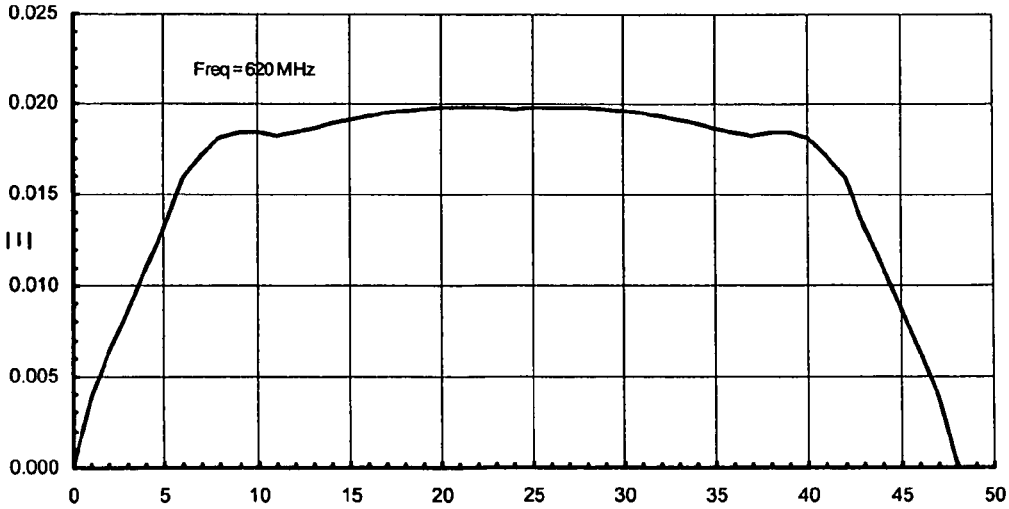
FIG. 10 is an example current distribution plot of electrical current versus position for a linear blade dipole with inductive loads near each dipole end.

FIG. 10 is an example of electrical current versus axial position for a linear blade dipole with inductive loads near each dipole end in accordance with the present application. In contrast, center loading produces an electric current distribution that is almost triangular. FIG. 10 shows the magnitude of the axial current along a dipole with inductive loads placed symmetrically away from the center. The electric current is approximately constant between the two inductances. The improvement in power radiated from this flat-topped current distribution as compared with a triangular one is approximately evaluated as the ratio of the areas under the respective currents.

Figure 11:
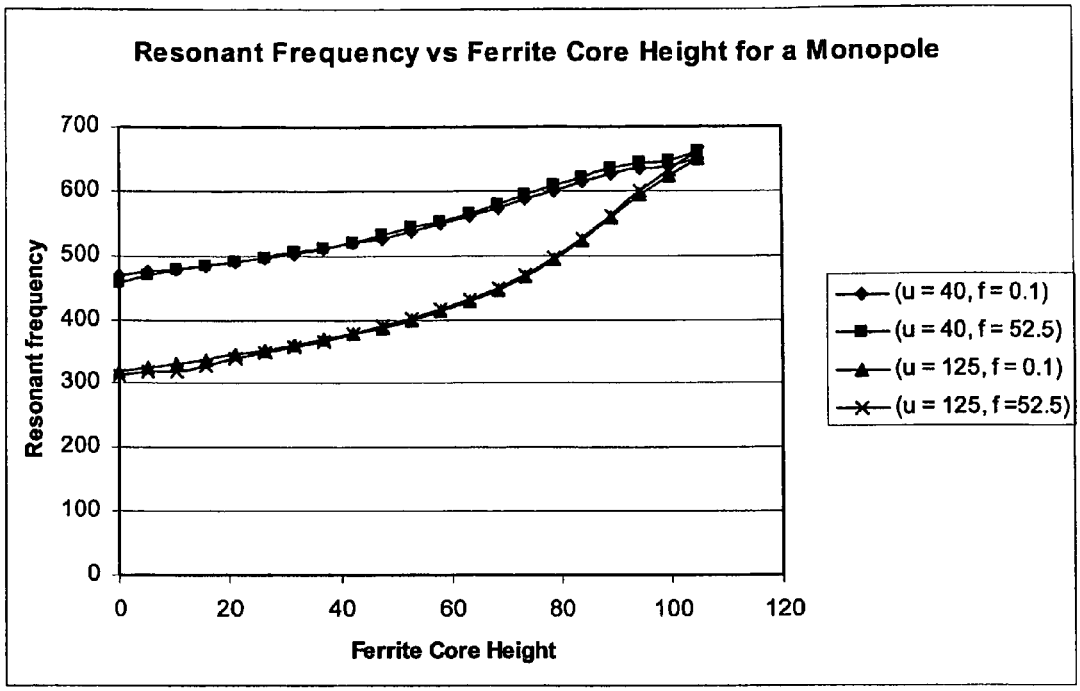
FIG. 11 is an example plot of resonant frequency versus ferrite core position on a monopole.
Figure 12:
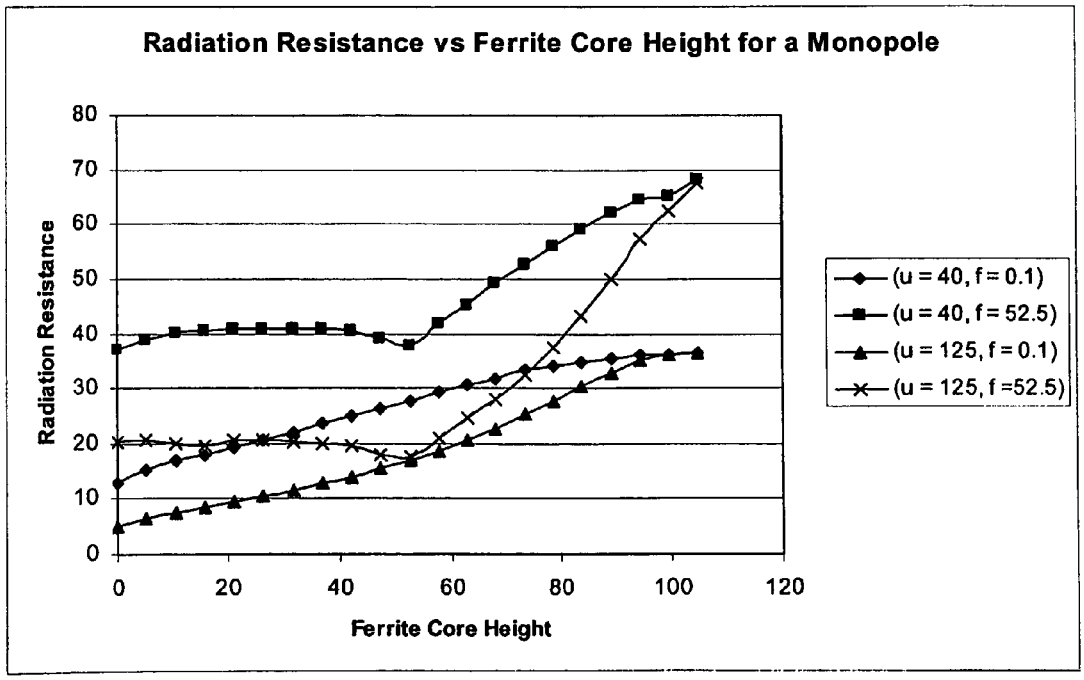
FIG. 12 is an example plot of radiation resistance versus ferrite core position on a monopole.

FIG. 11 is an example illustrating a resonant frequency modification via a ferrite bead on a monopole in accordance with the present application. At frequencies below 100 MHz the inductances used to lower the resonant frequency (and to shape the current distribution) may be realized with lumped inductors comprising wire-wound coils. However, at higher frequencies, ferrite beads may be a more desirable inductance source. FIG. 11 shows simulation data for a monopole of 10.5 cm in height and 1.5875 mm in radius that is attached to a square ground plane 45.7 cm on each side. Input impedances have been computed using High Frequency Structural Simulation (HFSS) to simulate the effect of a ferrite bead of 9.525 mm in outside diameter, 4.75 mm in inside diameter, and a height of 6.35 mm. The monopole is excited by a port source at its midpoint (52.5 mm) and base (0.1). Beads of two values of permeability (μ) were used. As seen in FIG. 11, both beads, when located some distance from the end of the monopole, were effective in lowering the resonant frequency. Referring to FIG. 12, the ferrite beads also alter the current distribution on the monopole and correspondingly change the input resistance.

Figure 13:
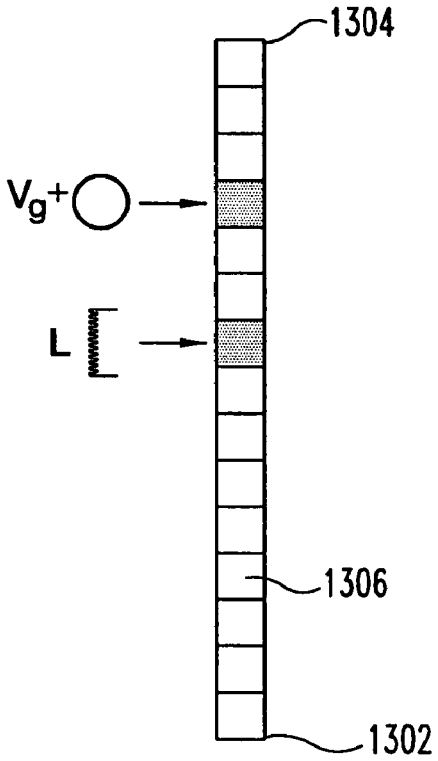
FIG. 13 is an illustration of a further type of resonator.
Figure 14:
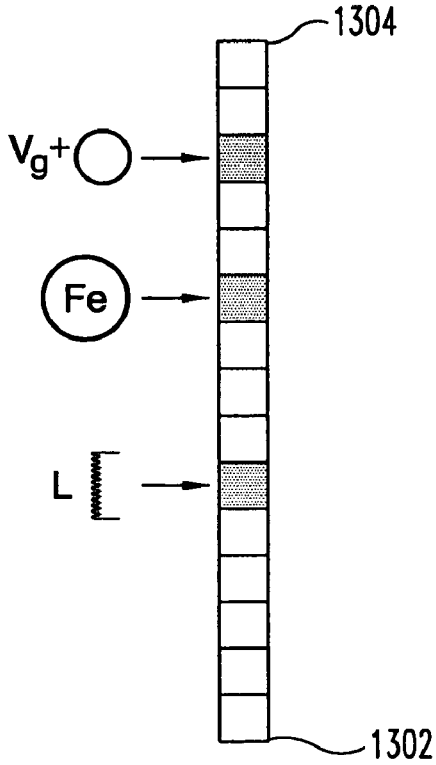
FIG. 14 is a diagrammatic view of an exemplary planar dipole configuration showing moment modeling domains as rectangles. The geometry shown in FIG. 14 includes lines depicting the edges of planar subsectional divisions of the area of the conductor that include (a) a voltage source, (b) a ferrite bead and (c) a lumped inductor.

FIG. 13 is an illustration of another resonator of the present application. The embodiment of FIG. 13 may comprise a physical resonator and/or a conceptual resonator demonstrating a method of estimating a resonator response as a function of component selection, placement, and antenna stimulus. In one simulation, the resonator is simulated as a flat strip that is divided into sections or patches along the length. For example, the segment 1306 in FIG. 13 represents a section of the depicted resonator. One end of the resonator is selected as the beginning 1302 and one end of the resonator is selected as the end 1304. In a resonator that may be circular and/or contiguous (not shown), an arbitrary location on the resonator may be selected as the beginning 1302. FIG. 14 is still another resonator of the present application that further schematically depicts ferrite bead Fe; where like reference numerals refer to like features.

Figure 16:
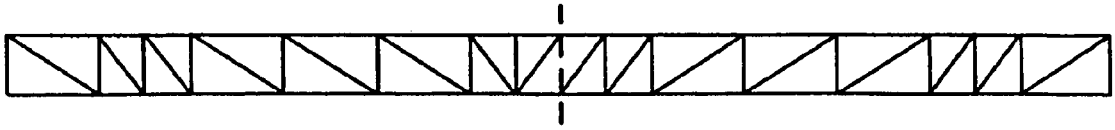
FIG. 16 is a schematic diagram of a set of patches used form FERM/LFMoM analysis of a blade dipole, where double half-patches in the center represent the source and those closer to each end represent a load.
Figure 17:
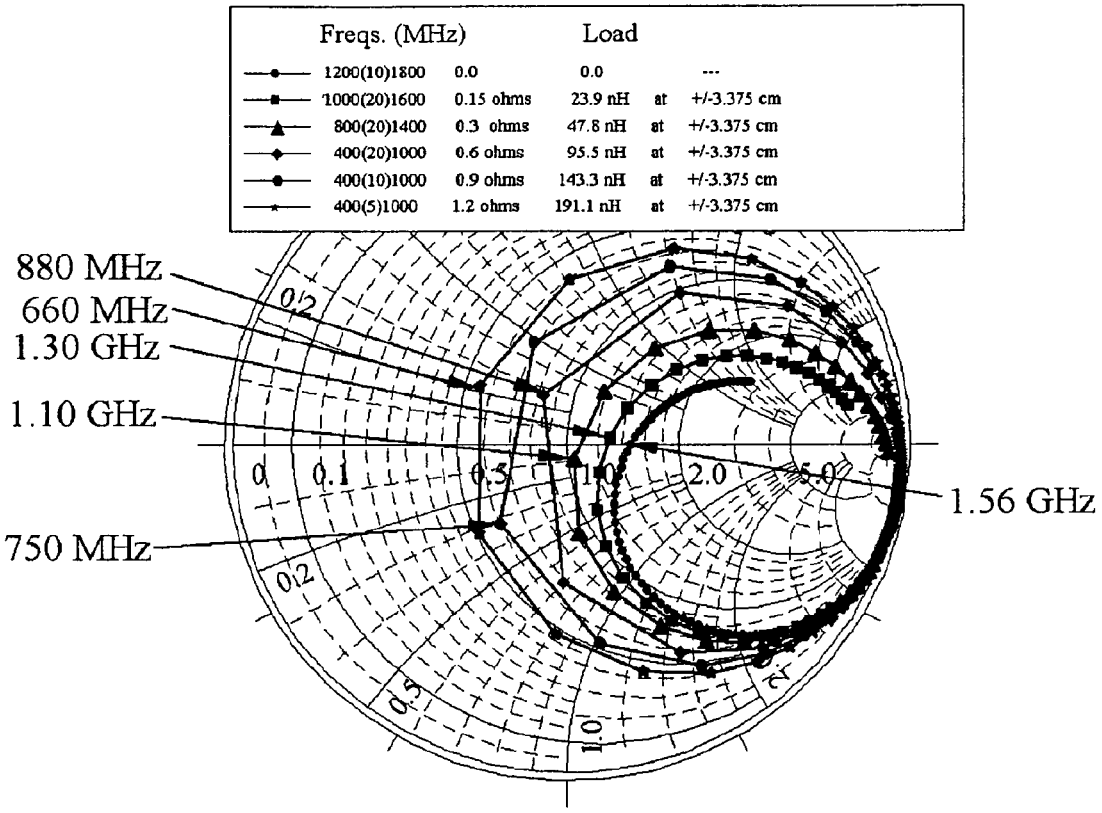
FIG. 17 is an example Smith Chart illustrating computed input impedance for center-fed blade dipole antennas with different load inductances.
Figure 18:
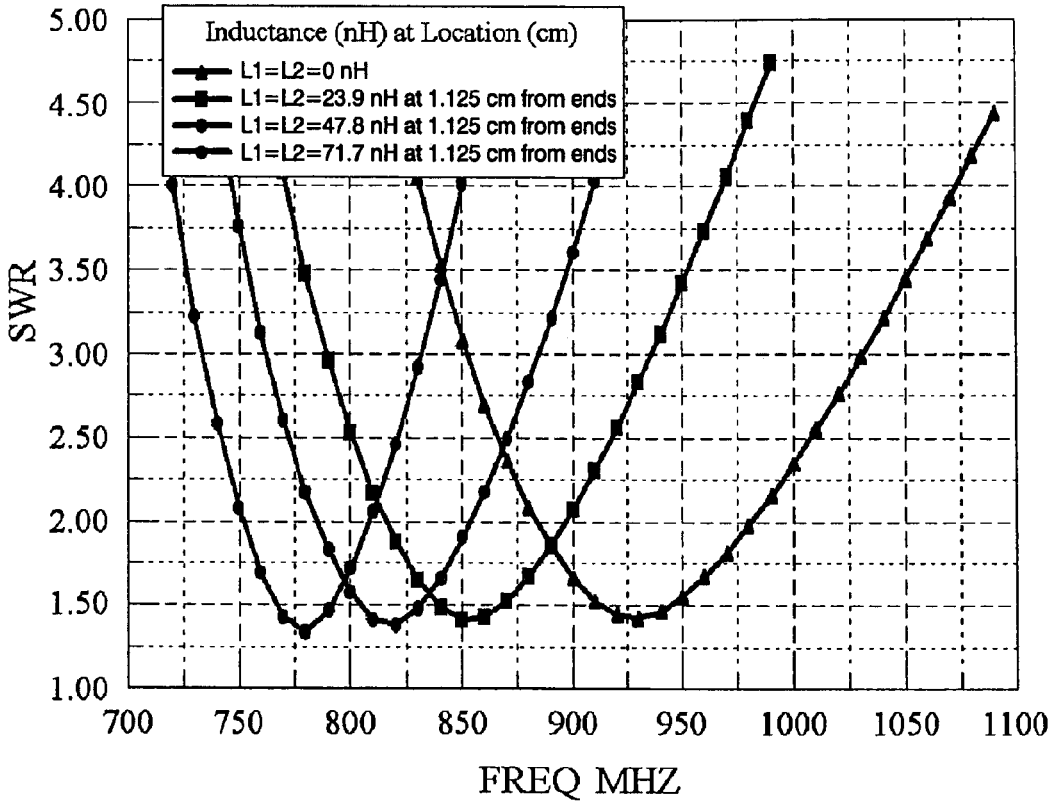
FIG. 18 is a plot of Standing Wave Ratio (SWR) for several center-fed blade dipole antennas each having different inductive loading located near the ends of the dipole.
Figure 19:
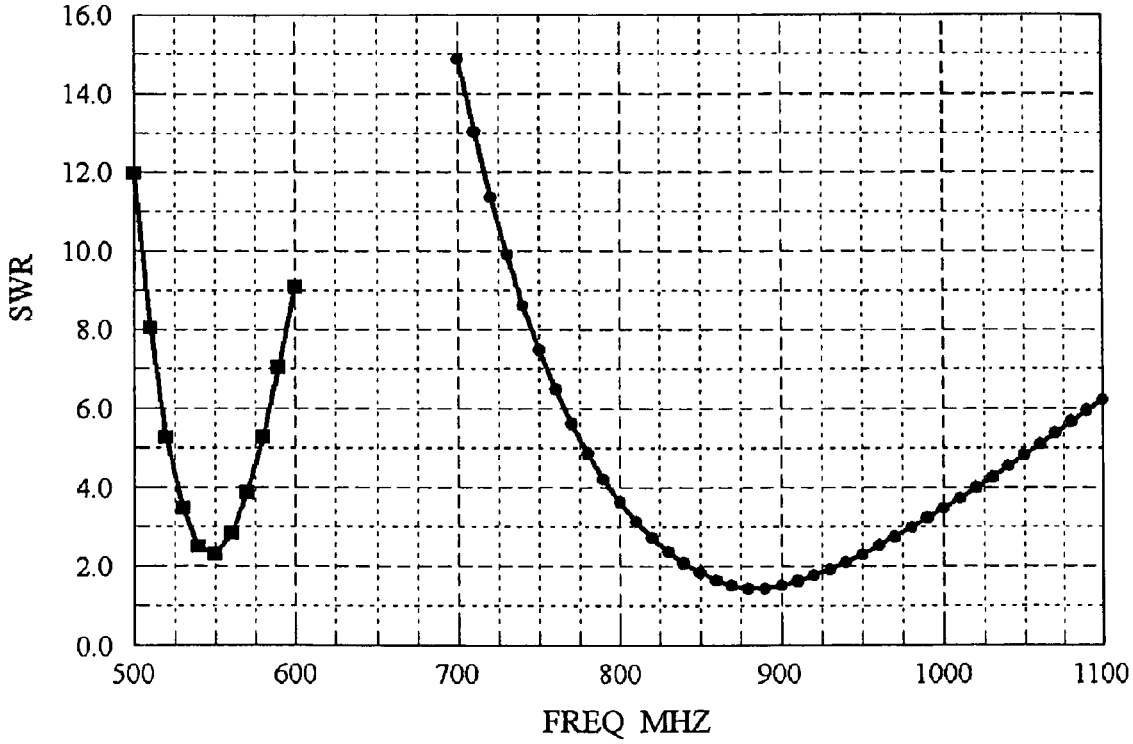
FIG. 19 is a further plot of Standing Wave Ratio (SWR) for two center-fed blade dipole antennas with different inductive loading by inductors near to the feed point.

FIG. 16 depicts one analysis model that was modified from a FERM (Finite Element Radiation Model) to compute the electrical properties of inductively loaded dipoles. Correspondence between the data for such flat dipoles and those with circular cross section has been established. FIG. 17 gives a set of results computed using FERM and LFMoM for the input impedance of a center-fed blade dipole with different load inductors. The blade dipole had a half-length of 4.5 cm and half-width of 0.25 cm. High Frequency Structural Simulation (HFSS) of the impedance of the same antenna produced consistent results. The blade dipole loads were placed near the ends (as schematically depicted in FIG. 16), with double half-size patches denoting the presence of a lumped element at the junction between the patches. When there is no load, the impedance locus agrees with expectations. As the value of the inductors increase, the resonant frequency, resonant resistance, and the bandwidth decrease in the manner shown by the SWR plots of FIG. 18. FIG. 18 indicates a resonant frequency fr of 930 MHz for L=0 (zero) and 820 MHz for L=47.8 nH. For comparison, FIG. 19 provides SWR plots for a dipole length of 15.75 cm and width of 0.5 cm that is loaded nearer to the feed point illustrating an fr of 880 MHz for L=0 and an fr of 550 MHz for L=47.8 nH.

Figure 20:
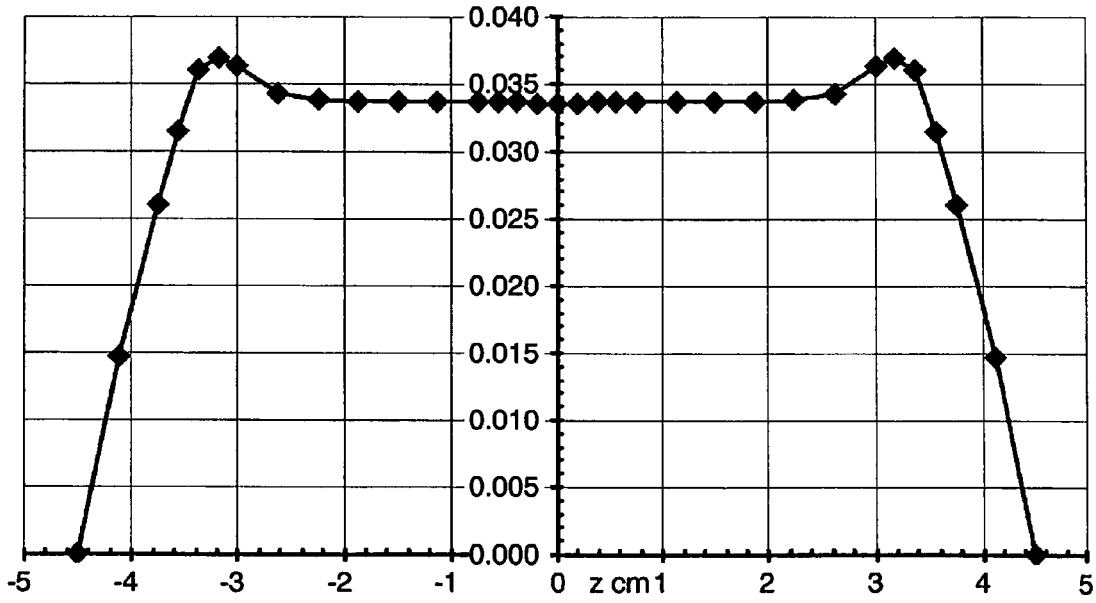
FIG. 20 is an example current distribution plot of electrical current versus position for a blade dipole that is loaded near its ends so that the resulting current distribution is nearly constant.

The location of the inductor with respect to the dipole geometry has been observed to influence current distribution. The current distribution plot of FIG. 20 provides current distribution on a blade dipole with +/−4.5 cm length along the horizontal z axis (when z=0 is the center) that is loaded with 191 nH inductors at approximately 1.1 cm from each end (+/−about 3.375 cm relative to the z axis) at a frequency of 660 MHz. Note that the value of 191 nH produces a nearly constant current between the loads. The benefit gained by placing the load inductor near the ends of the dipole is illustrated by comparing the results shown in FIG. 19 with those shown in FIG. 18. The progression of decreasing input resistance at resonance is desirably less in FIG. 18 model compared to the FIG. 19 model. As a result, a small dipole loaded near the end has a higher value of resonant resistance than one for which the load is closer to the midpoint of the dipole.

Simulation experimental results have been confirmed by experiments with a physical model of a blade dipole. The dipole was formed of a narrow strip of thin copper (0.5 cm×7.5 cm) and was fed as a monopole above a 43.5-in copper ground plane. A chip inductor provided the load that had a nominal value of 82 nH and was placed at various distances from the center. The input impedance was measured by an Agilent E8363B network analyzer. The measured values were found to be in good agreement with the simulation results.

Figure 21:
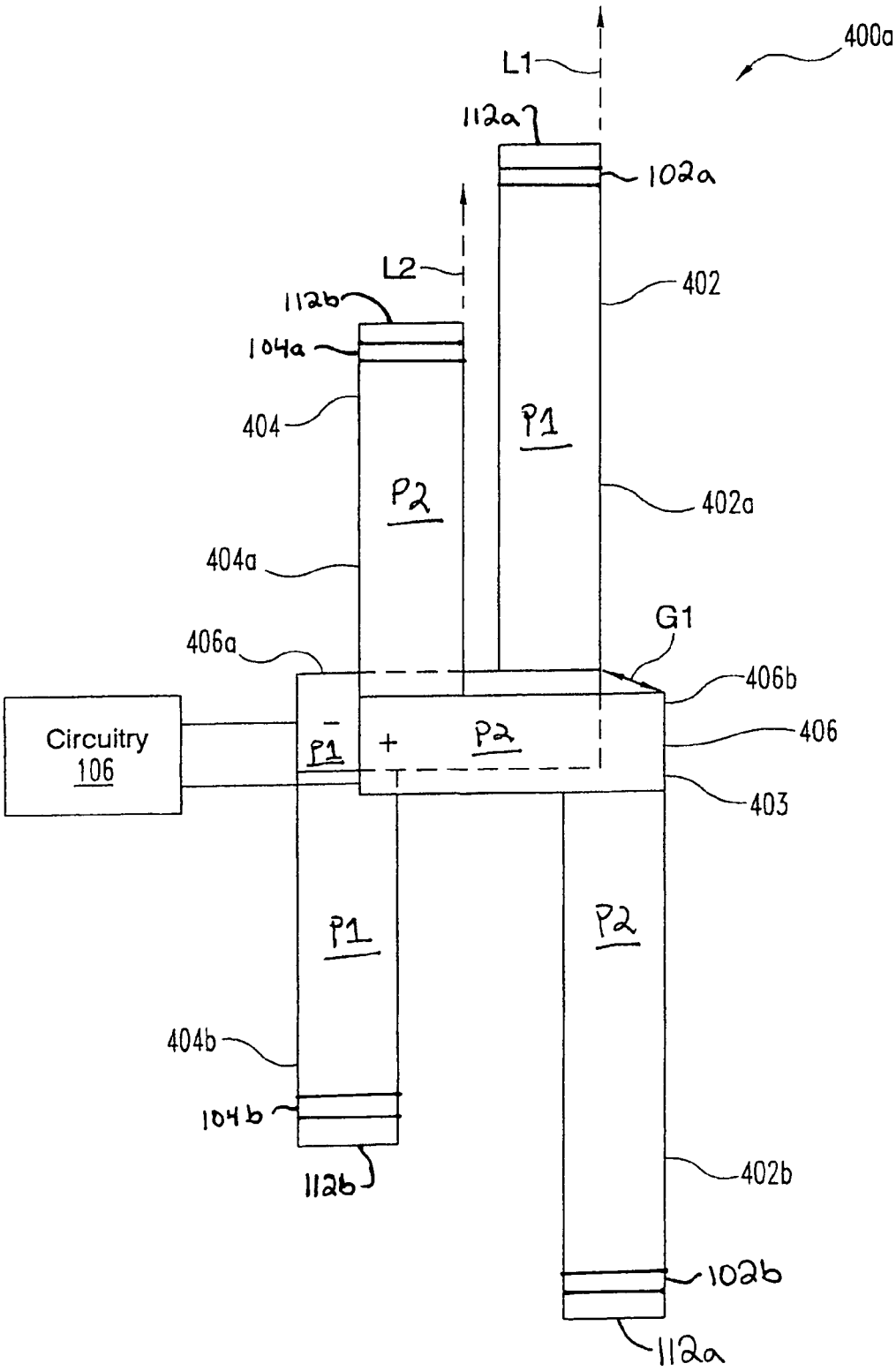
FIG. 21 is a partially diagrammatic, perspective view of two dipole antennas of different length with a transposed (crossed) feed line connection.
Figure 22:
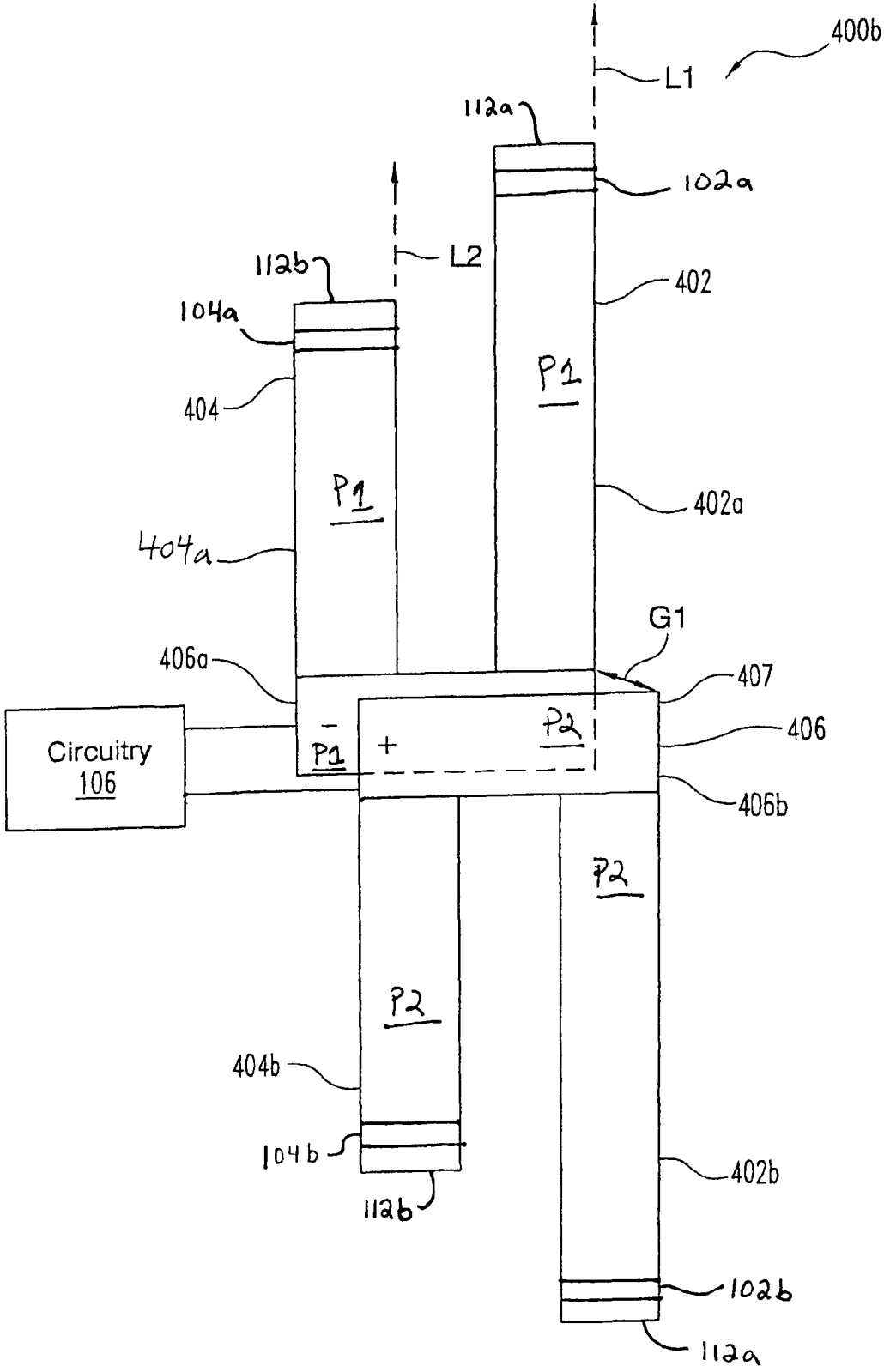
FIG. 22 is a partially diagrammatic, perspective view of the dipole antennas of FIG. 21 without a transposed connection.

In a further embodiment, transposition of feed line connections to antennas was evaluated to determine if a more constant impedance magnitude might be obtained. FIGS. 21 and 22 provide comparative diagrammatic illustrations to show a transposed (or crossed) feed line connection (FIG. 21) relative to a feed line connection that is not transposed or crossed; where like reference numerals refer to like features. FIG. 21 depicts transposed feeder antenna system 400*a* that includes two dipole antennas 402 and 404 of different length. FIG. 22 depicts antenna system 400*b* without feeder transposition. For both systems 400*a* and 400*b*, dipole antenna 402 includes two legs 402*a* and 402*b* that are approximately the same length and dipole antenna 404 includes two legs 404*a* and 404*b* that are approximately the same length. In contrast, legs 402*a* and 402*b* are each relatively unequal to the length of either leg 404*a* or 404*b*. Each system 400*a* and 400*b* includes circuitry 106 (as previously described), that is coupled to the feed line 406 to receive and/or transmit signals through dipole antennas 402 and/or 404.

Feed line 406 includes feed line connection pathway 406*a* (negative "−") and feed line connection pathway 406*b* (positive "+"). Pathways 406*a* and 406*b* are separated by a gap G1, and terminate in an open circuit opposite the connection of feed line 406 to circuitry 106. In FIG. 21, pathway 406*a* is connected to legs 402*a* and 404*b* of unequal length, and pathway 406*b* is connected to legs 402*b* and 404*a* of unequal length. This arrangement of system 400*a* provides transposed feed line connections 403. In contrast, for system 400*b* of FIG. 22 pathway 406*a* is connected to legs 402*a* and 404*a*, and pathway 406*b* is connected to legs 402*b* and 404*b*. This system 400*b* arrangement provides non-transposed feed line connections 407. The transposed feed line connection 403 of system 400*a* provides a 180 degree out-of-phase relationship relative to the non-transposed feed line connection 405 of system 400*b*.

In one orientation, dipole antennas 402 and 404 each extend along a longitudinal axis L1 and L2, respectively; where axes L1 and L2 are approximately parallel to each other. However, it should be appreciated that in other embodiments, a different geometry/orientation may be implemented. In one implementation corresponding to the depictions of FIGS. 21 and 22; antenna 402, antenna 404, pathway 406*a*, and pathway 406*b* are provided in the form of generally planar thin strips of metal; however, in other implementations a different configuration may be utilized. Further, it should be appreciated that orientation of system 400*a* generally places legs 402*a* and 404*b* in a first plane P1, and legs 402*b* and 404*a* in a second plane P2 that is parallel to plane P1 and spaced apart from it by gap G1. In contrast, system 400*b* places legs 402*a* and 404*a* in plane P1, and legs 402*b* and 404*b* in plane P2. For the perspective views of FIGS. 21 and 22, pathway

406*a* is included in plane P1 and pathway 406*b* is included in the plane P2, with plane P2 being in the foreground relative to plane P1.

Figure 23:
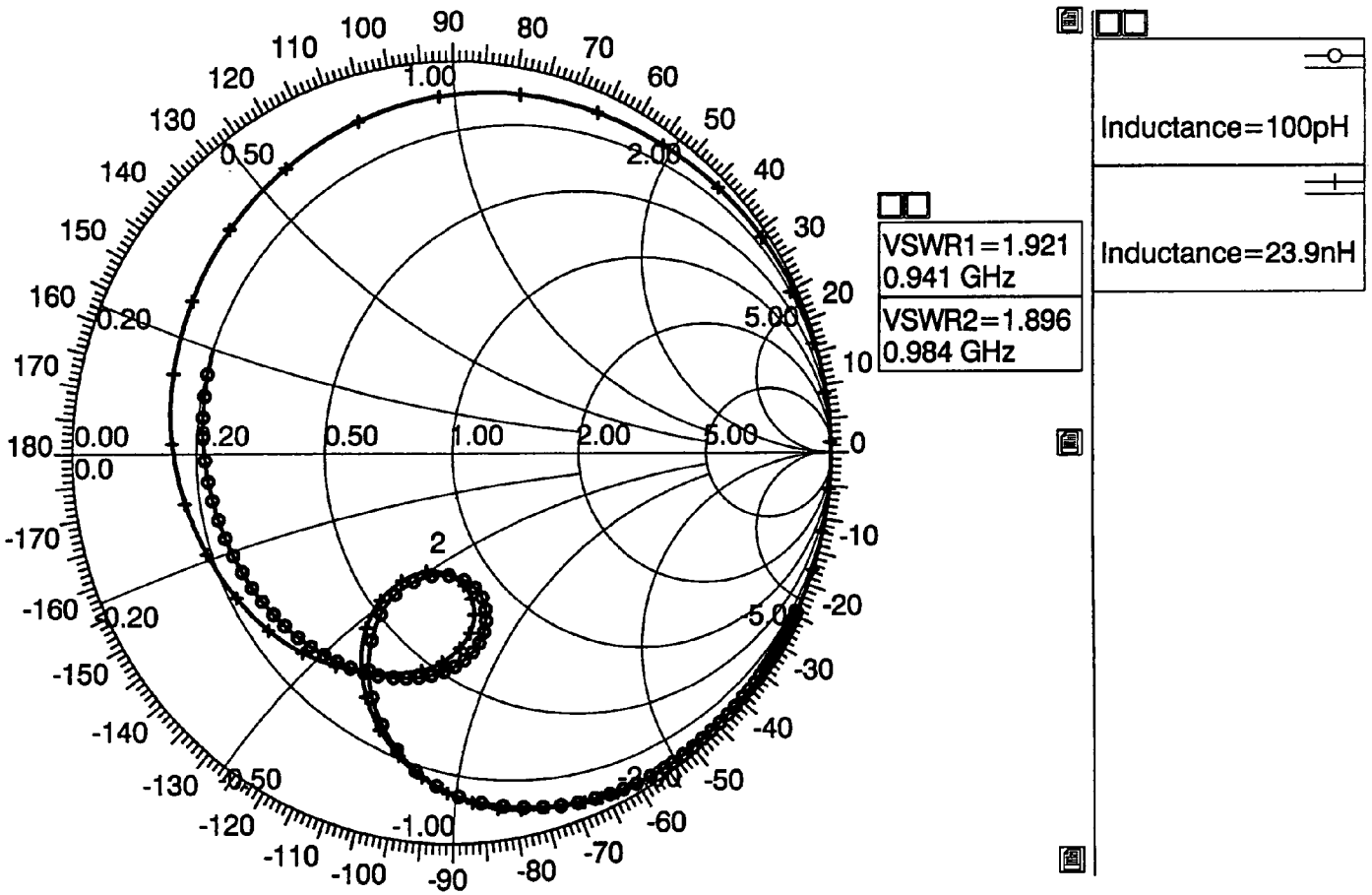
FIG. 23 is an example Smith Chart with plots for two out-of-phase dipole antennas in parallel, which corresponds to a transposed feed line connection.

Several simulations were performed. In one example, two dipole antennas made from thin conducting material, 0.5 cm in width, are cut to lengths of 9 and 15 cm. These antennas are connected to a transposed feed-line made from two strips of the same material, separated by 0.125 cm and of 0.75 cm width. The system is excited, for purpose of analysis, by a voltage generator at the base of the shorter dipole. The Smith Chart input impedance plot of FIG. 23 demonstrated the existence of a loop for an array of two dipoles with the following dimensions: $H_1$=4.5 cm, $H_2$=7.5 cm, $w_1$=$w_2$=0.5 cm, width of flat feed line conductors=0.75 cm, separation between feed line conductors=0.25 cm, and length of feed line=0.5 cm. This plot represents an array with an approximately unloaded dipole antenna (circle-shaped plot points) and lightly loaded (23.9 nH) dipole antenna (x-shaped plot points) with a transposed feed line connection as obtained with HFSS. Comparable results were obtained with FERM/LFMoM.

Figure 24:
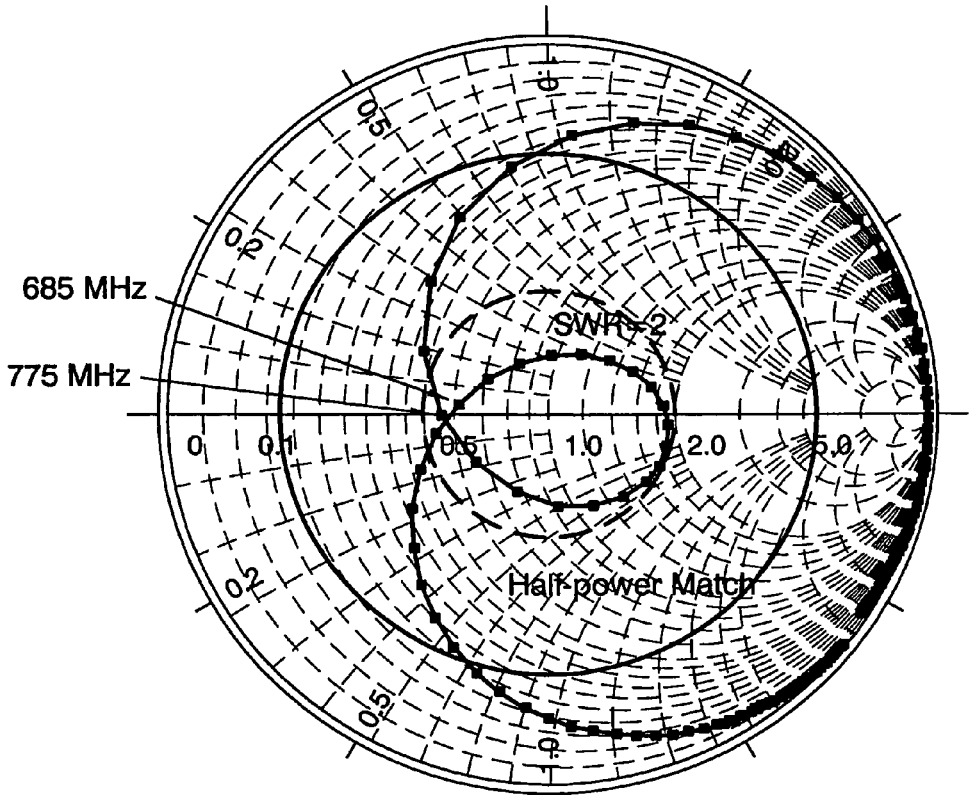
FIG. 24 is an example Smith Chart with plots of input impedance of a transposed feeder arrangement adjusted to provide a loop inside the SWR=2 circle.

The Smith Chart plot of FIG. 24 represents computed input impedance of a two-element array of parallel blade dipole antennas that are center-fed with 180-degrees added between the elements to simulate a transposed (crossed) feeder. The first dipole antenna has a length of 15.0 cm and the second dipole antenna has a length of 9.28 cm. The width of each antenna is about 0.5 cm and distance between the centerlines is about 1 cm. The first dipole antenna is loaded with two 125.15 nH inductors at +/−3.93 cm and the second dipole antenna is loaded with two 136.5 nH inductors at +/−6.79 cm. Provision was made in the simulation for placing loading elements on the second patch from each end of the dipole. Input impedance was computed again for increasing values of inductive load. The impedance band encompassed by the loop moves down in frequency as the inductance is increased. Thus, the match band can be obtained continuously as the load is varied.

Figure 25:
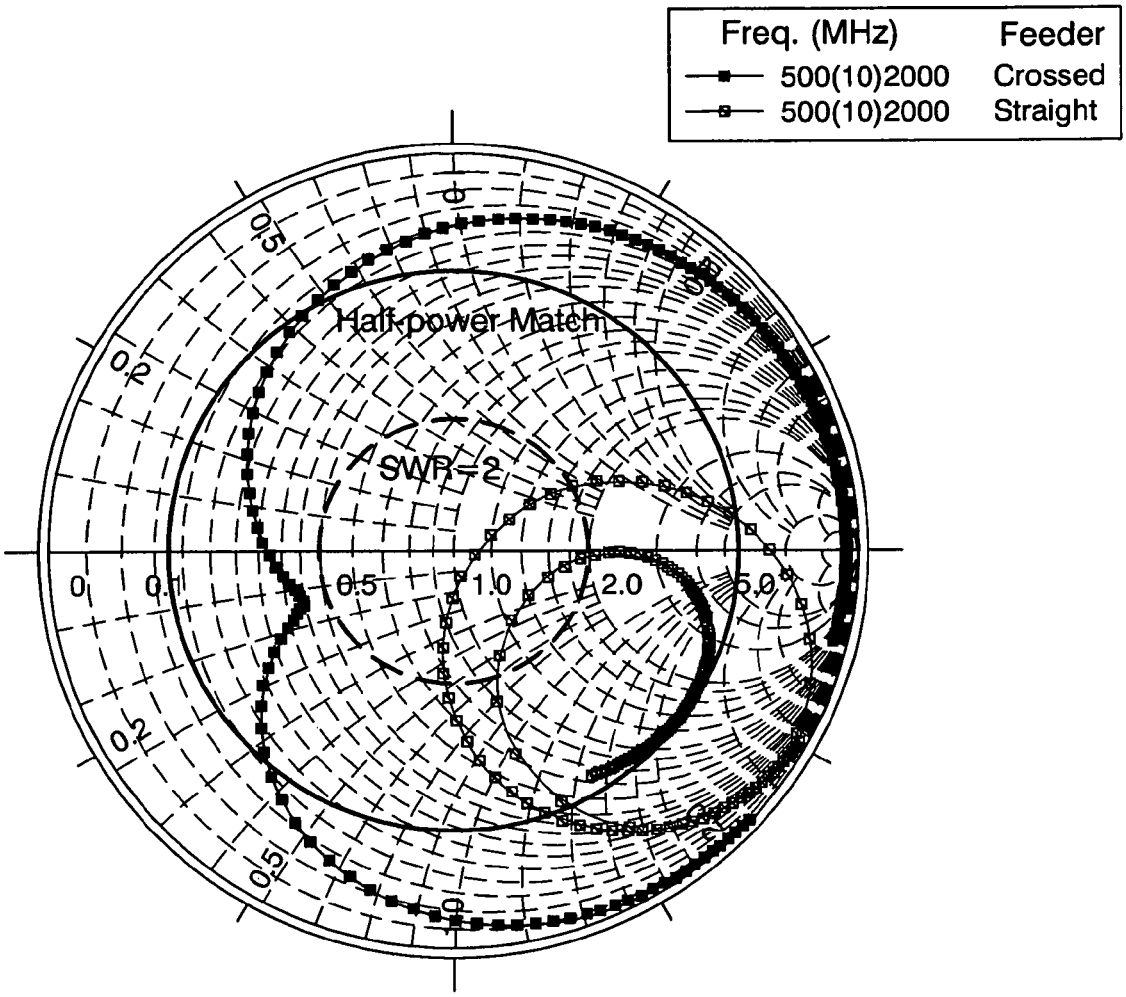
FIG. 25 is an example Smith Chart with plots to compare a transposed feeder and a feeder that is not transposed for an array with two inductively loaded dipoles of different length.

There are several parameters that can affect performance. For instance, a change in separation between the planes of the elements has been shown to alter shape and position of a Smith Chart loop. Further, it has been demonstrated that a reduction in the average real impedance of the points within the loop can be matched by a change in the feed line impedance. In addition, the Smith Chart plots of FIG. 25 further show the influence of feeder transposition. In FIG. 25, the curve formed by square plot points corresponds to a transposed feeder that appears to be leading to a broadband loop, while the curve formed by circle plot points corresponds to a non-transposed feeder that is producing a two-band match. This comparison was provided by a two dipole antenna array with one dipole having a length of 12.14 cm and the other of 15.0 cm. The dipole width of both was 0.5 cm and the distance between centerlines was 1 cm.

Many different embodiments of the present application are envisioned. For instance the antenna devices may include more than two antennas with different resonant frequencies with or without transposed feeder connections or the like. Alternatively or additionally, inductive loading of each antenna is provided with an inductor device of a different inductance, an inductor device is positioned a different distance from the feed line, and/or the inductor device is positioned closer to the outer end than the feed line.

In a further example, an apparatus includes: an antenna array device including several electrically small dipole antennas coupled in parallel to one another, each of the dipole antennas extending a different length and corresponding to a resonator with a different resonant frequency to collectively define a greater effective number of operating frequencies than each of the dipole antennas operating separate from one another, the dipole antennas each including: two dipole ends, two inductor devices, two electrically conductive members each electrically coupled in series with a respective one of the inductor devices and each extending from a feed point to the respective one of the inductor devices; and for each respective one of the dipole antennas: each one of the two inductor devices being positioned closer to a respective one of the two ends than the feed connection, the feed point being positioned between the dipole ends and the inductor devices to provide a connection to transmit or receive signals through the antenna device, and length of the respective one of the dipole antennas being different than length of any other of the dipole antennas. In certain forms of this embodiment, inductance of the two inductor devices is closer in value to each other than to inductance of any of the two inductor devices for any other of the dipole antennas; the dipole antennas each include two other conductive members and the inductor devices are each electrically coupled between one of the conductive members and one of the other conductive members; the two conductive members for each one of the dipole antennas are closer in length to each other than to length of the conductive members for any other of the dipole antennas; and/or a feed line is coupled to the feed point of each of the antennas with at least one connection of the feed line to one of the antennas being transposed relative to another connection of the feed line to another of the antennas.

Still another embodiment includes: a first electrically small antenna including a first antenna leg extending from a first feed point to a first end, the first leg including a first inductor device electrically coupled between the first feed point and the first end to provide a first resonator, the first inductor device being spaced apart from the first feed point by a first distance; and a second electrically small antenna electrically coupled to the first antenna, the second antenna including a second antenna leg extending from a second feed point to a second end, the second leg including a second inductor device electrically coupled between the second feed point and the second end to provide a second resonator with a resonant frequency different than the first resonator, the second inductor device being spaced apart from the second feed point by a second distance greater than the first distance, and the second inductor device having an inductance greater than the first inductor device.

A further embodiment comprises: providing a plurality of dipole antennas coupled together to a feed line, the dipole antennas each extending a different length between opposing ends, the feed line being positioned between the opposing ends; for each of the antennas, incorporating two inductor devices that are each closer to a respective one of the opposing antenna ends than the feed line; selecting inductance of the two inductor devices for each of the antennas to define corresponding antenna resonators each having a different resonant frequency; and operating the antennas at an operating frequency with wavelength at least twice the effective operating length of each of the antennas. This embodiment may include: the inductance of the two inductor devices being closer to each other for each of the antennas than to either of the two inductor devices of any other of the antennas; transposing coupling of the feed line between a first one of the antennas and a second one of the antennas; providing the operating frequency with communication circuitry coupled to the feed line; and/or two electrically conductive members coupled to the feed line and each of the two inductors for each one of the antennas with the two electrically conductive members spanning a different distance for each one of the antennas.

One further nonlimiting embodiment is directed to a system, comprising: multiple resonators having differential resonance frequencies, a transceiver configured to communicate signals with the multiple resonators, a feed source configured to provide power to the multiple resonators. Further aspects of this system optionally include the feed source comprising a non-center feed location, at least one ferrite bead disposed on the at least one multiple resonator, a reactive component on at least one of the multiple resonators, an inductive load on at least one of the multiple resonators, and an embodiment wherein the inductive load(s) are configured to provide a high current across a wide range of axial locations in the multiple resonators at a wide range of excitation frequencies.

Still a further nonlimiting description of an invention of the present application is directed to a system, comprising: an antenna device including two dipole configurations, the dipole configurations each include a series resonator and are coupled in parallel, the dipole configurations are each electrically coupled to a feedpoint. In one form, the dipole configurations each include at least one reactive load or element in a predefined position relative to the feedpoint. In a further variation of this form, for at least one of the dipole configuration, the reactive load or element includes an inductor and the one dipole configuration includes a first electrically conductive member connected to a first terminal of the inductor, a second electrically conductive member connected to a second terminal of the inductor, and the first conductive member is electrically connected between the first terminal and the feedpoint. In still a further variation of this form, the inductor, the first member and the second member comprise a first dipole portion and a second inductor is included along a second dipole portion, the feed point being positioned between the first dipole portion and the second dipole portion. Alternatively or additionally, the feedpoint includes an electrical power source connected approximately in the center of each of the dipole configurations.

Yet another nonlimiting description of an invention is directed to a system, comprising: an antenna device including an electrical energy source with a first terminal and a second terminal, a first dipole configuration, and a second dipole configuration; the first dipole configuration includes two inductors; the second dipole configuration includes two other inductors; and the electrical energy source is connected to the first dipole configuration between the two inductors and to the second dipole configuration between the other two inductors. In one refinement of this invention, each of the two inductors each has a different inductance the each of the other two inductors and each of the two inductors is positioned relative to the electrical energy source a different distance than either of the other two inductors.

A further nonlimiting description of an invention is directed to a method, comprising: providing an antenna device including an electrical energy source with a first terminal and a second terminal, a first dipole configuration including two first dipole antenna members each having a corresponding one of a first pair of inductors, a second dipole configuration including two second dipole antenna members each having a corresponding one of a second pair of inductors; and adjusting at least one of position and inductance of the first pair of inductors to increase uniformity of axial electric current along the first dipole antenna member. As a further refinement, adjusting at least one of position and inductance of the second pair of inductors to increase uniformity of axial electric current along the second dipole antenna member. As an addition or alternative to this refinement, providing the first pair of inductors to have approximately the same inductance, providing the second pair of inductors to have approximately the same inductance, and/or providing each of the first pair of inductors to have a different inductance than each of the second pair of inductors.

All patents, patent applications, and publications references herein are hereby incorporated by reference, each in its entirety, including but not limited to:

Mayes et al., Tuning circuit for edge-loaded nested resonant radiators that provides switching among several wide frequency bands, U.S. Pat. No. 6,337,664, filed Oct. 21, 1998.

Gee et al., Tuning circuit for edge-loaded nested resonant radiators that provides switching among several wide frequency bands, U.S. Pat. No. 6,608,598, filed Jan. 7, 2002.

Any experimental (including simulation) results are exemplary only and are not intended to restrict any inventive aspects of the present application. Any theory, mechanism of operation, proof, or finding stated herein is meant to further enhance understanding of the present application and is not intended to make the present application in any way dependent upon such theory, mechanism of operation, proof, or finding. Simulations of the type set forth herein are recognized by those skilled in the art to demonstrate that antenna methods, systems, apparatus, and devices, are suitable for their intended purpose. While the terms: "feed line," "feed configuration," "feeder," and "feed point" are typically described in the context of signal transmission to an antenna with respect to the experiments and results described herein, it should be appreciated that these terms as used in the claims that follow to refer to an antenna coupling that may be used to transmit signals to an antenna, receive signals from an antenna, or both transmit and receive signals to/from an antenna. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein or by any claims that follow are desired to be protected.

What is claimed is:

1. An apparatus, comprising:

an antenna device including several electrically small dipole antennas coupled in parallel to one another, each of the dipole antennas extending a different length than any other of the dipole antennas, and the dipole antennas each corresponding to a resonator with a different resonant frequency to collectively define a number of operating frequencies, the dipole antennas each including:

a feed point;

two dipole ends;

two inductor devices, the feed point being positioned between the two dipole ends and between the two inductor devices to provide a connection to transmit or receive signals through the antenna device; and two electrically conductive members each extending from the feed point to a respective one of the two inductor devices, the two inductor devices each being positioned closer to a respective one of the two dipole ends than the feed point for each of the dipole antennas.

2. The apparatus of claim 1, wherein inductance of the two inductor devices is closer in value to each other than to inductance of any of the two inductor devices for any other of the dipole antennas.

3. The apparatus of claim 1, wherein the dipole antennas each include two other conductive members, and the inductor devices are each electrically coupled between one of the conductive members and one of the other conductive members.

4. The apparatus of claim 1, wherein the two conductive members for each one of the dipole antennas are closer in length to each other than to length of either of the two conductive members for any other of the dipole antennas.

5. The apparatus of claim 1, further comprising a feed line coupled to the feed point of each of the antennas, at least one coupling of the feed line to one of the antennas being transposed relative to another coupling of the feed line to another of the antennas.

6. The apparatus of claim 1, further comprising:

communication circuitry coupled to the feed point of the antennas; and a signal processor coupled to the communication circuitry.

7. An apparatus, comprising:

a first electrically small antenna including a first antenna leg extending from a first feed point to a first end, the first leg including a first inductor device electrically coupled between the first feed point and the first end to provide a first resonator, the first inductor device being spaced apart from the first feed point by a first distance; and a second electrically small antenna electrically coupled to the first antenna, the second antenna including a second antenna leg extending from a second feed point to a second end, the second leg including a second inductor device electrically coupled between the second feed point and the second end to provide a second resonator with a resonant frequency different than the first resonator, the second inductor device being spaced apart from the second feed point by a second distance greater than the first distance, and the second inductor device having an inductance greater than the first inductor device.

8. The apparatus of claim 7, wherein the first inductor device is positioned a third distance from the first end and the second inductor device is positioned a fourth distance from the second end, the third distance being greater than the fourth distance.

9. The apparatus of claim 7, wherein the first antenna and the second antenna are coupled in parallel with each other, and each include a further leg to define two dipole antennas.

10. The apparatus of claim 7, further comprising a feed line coupled to the first feed point and the second feed point in a transposed relationship.

11. The apparatus of claim 7, further comprising:

communication circuitry coupled to the first antenna and the second antenna; and a signal processor coupled to the communication circuitry.

12. The apparatus of claim 7, wherein the first antenna includes a further leg to define a dipole antenna type, and the further leg includes a further inductor device with an inductance closer in value to the first inductor device than the second inductor device.

13. A method, comprising:

providing a plurality of dipole antennas coupled together to a feed line, the dipole antennas each extending a different length between opposing dipole antenna ends, the feed line being positioned between the opposing ends;

for each of the antennas, incorporating two inductor devices, the two inductor devices each being closer to a respective one of the opposing dipole antenna ends than the feed line;

selecting inductance of the two inductor devices for each of the dipole antennas to define corresponding dipole antenna resonators each having a different resonant frequency; and operating each of the antennas at an operating frequency with a wavelength that is at least twice the length of each of the dipole antennas.

14. The method of claim 13, wherein the inductance of the two inductor devices is closer to each other for each of the antennas than to the two inductor devices of any other of the antennas.

15. The method of claim 13, which includes transposing connection of the feed line to a first one of the dipole antennas relative to a connection of the feed line to a second one of the antennas.

16. The method of claim 13, which includes providing the operating frequency with communication circuitry coupled to the feed line.

17. The method of claim 14, wherein two electrically conductive members are coupled to the feed line and each of the two inductors for each one of the antennas, and the two electrically conductive members span a different distance for each one of the antennas.

18. The method of claim 13, wherein at least two of the dipole antennas each extend along a longitudinal axis approximately perpendicular to one another.

19. A method, comprising:

providing a first antenna spanning a first length that includes one or more electrically conductive members coupled to one or more inductors to define a first resonant frequency;

providing a second antenna spanning a second length that includes one or more other electrically conductive members coupled to one or more other inductors to define a second resonant frequency, the one or more inductors each having a different inductance than either of the one or more other inductors;

coupling the first antenna and the second antenna together with a feed line;

connecting the feed line to communication circuitry;

communicating a first signal through the feed line at a first operating frequency of the communication circuitry, the first operating frequency having a wavelength greater than twice the first length and a second signal at a second operating frequency having a wavelength greater than twice the second length.

20. The method of claim 19, wherein the coupling of the first antenna and the second antenna includes transposing the feed line connection.

21. The method of claim 20, wherein the first antenna extends along a first longitudinal axis, the second antenna extends along a second longitudinal axis, and the first longitudinal axis and the second longitudinal axis are generally parallel to one another.

22. The method of claim 19, wherein a first one of the conductive members and first one of the other conductive members are generally coplanar with respect to a first plane.

23. The method of claim 22, wherein the first one of the conductive members extends away from the feed line connection in a direction opposite the first one of the other conductive members.

24. The method of claim 22, wherein a second one of the conductive members and a second one of the other conductive members are generally coplanar with respect to a second plane, and the first plane and the second plane are spaced apart from one another and are generally parallel.

25. The method of claim 19, wherein the first antenna and the second antenna are coupled in parallel.

26. The method of claim 19, wherein the first antenna includes two legs that are approximately oriented perpendicular to one another and the second antenna includes two other legs that are approximately oriented perpendicular to one another.

27. The apparatus of claim 7, wherein the first antenna includes another leg oriented approximately perpendicular to the first leg and the second antenna includes a further leg that is approximately perpendicular to the second leg, and the first leg and the second leg are positioned opposite each other along an axis.

* * * * *